US011344463B2

(12) United States Patent
Sherman et al.

(10) Patent No.: US 11,344,463 B2
(45) Date of Patent: May 31, 2022

(54) DELAYED CORD CLAMPING SYSTEM

(71) Applicant: Children's National Medical Center, Washington, DC (US)

(72) Inventors: Jules P. Sherman, Palo Alto, CA (US); Douglas F. Schwandt, Palo Alto, CA (US); Chris A. Rothe, San Mateo, CA (US)

(73) Assignee: Children's National Medical Center, Washington, DC (US)

( * ) Notice: Subject to any disclaimer, the term of this patent is extended or adjusted under 35 U.S.C. 154(b) by 348 days.

(21) Appl. No.: 16/284,786

(22) Filed: Feb. 25, 2019

(65) Prior Publication Data

US 2020/0268583 A1 Aug. 27, 2020

(51) Int. Cl.

| | |
|---|---|
| ***A61G 11/00*** | (2006.01) |
| ***A61G 13/10*** | (2006.01) |
| ***A61G 13/12*** | (2006.01) |

(52) U.S. Cl.

CPC ..... *A61G 13/105* (2013.01); *A61G 11/00* (2013.01); *A61G 13/12* (2013.01); *A61G 13/101* (2013.01); *A61G 2210/90* (2013.01)

(58) Field of Classification Search

CPC ..... A61G 11/00; A61G 13/105; A61G 13/12
See application file for complete search history.

(56) References Cited

U.S. PATENT DOCUMENTS

| | | | | | |
|---|---|---|---|---|---|
| 4,750,474 | A * | 6/1988 | Dukhan | A61G 11/00 | 128/205.26 |
| 4,757,811 | A | 7/1988 | Clark | | |
| 5,162,038 | A * | 11/1992 | Wilker | A61G 11/00 | 119/306 |
| 5,841,944 | A * | 11/1998 | Hutchinson | H05B 3/42 | 392/418 |
| 5,980,449 | A * | 11/1999 | Benson | A47C 21/048 | 600/22 |
| 2004/0236174 | A1* | 11/2004 | Boone | A61G 11/00 | 600/21 |
| 2011/0113555 | A1 | 5/2011 | Smith | | |
| 2014/0300476 | A1* | 10/2014 | Sabota | G08B 5/36 | 340/573.1 |
| 2014/0364722 | A1 | 12/2014 | Dumoulin | | |

FOREIGN PATENT DOCUMENTS

WO WO 2017/053406 3/2017

* cited by examiner

*Primary Examiner* — John P Lacyk
(74) *Attorney, Agent, or Firm* — Oblon, McClelland, Maier & Neustadt, L.L.P.

(57) ABSTRACT

A delayed cord-clamping surface is provided that includes a newborn platform having a recessed surface configured to receive a chemical warming mattress, where the chemical warming mattress includes a conformable surface, where the newborn platform includes a detachable platform support that is configured to position the newborn platform proximal to a surgical region of a C-section patient, where the newborn platform is configured to support a newborn baby while an umbilical cord remains connected between the newborn and the C-section patient for draining from a placenta, where the newborn platform is configured to fitably mount with a warming table when the newborn platform is in a detached state from the detachable platform support.

41 Claims, 24 Drawing Sheets

DELAYED CORD CLAMPING SYSTEM

STATEMENT REGARDING FEDERALLY SPONSORED RESEARCH OR DEVELOPMENT

This invention was made with Government support under contract P30 HS023506 awarded by the Agency for Healthcare Research and Quality. The Government has certain rights in the invention.

FIELD OF THE INVENTION

The present invention relates generally to newborn baby delivery platforms. More particularly, the present invention relates to a fully articulatable newborn supporting platform to effectively delay cord clamping.

BACKGROUND OF THE INVENTION

In delayed umbilical cord clamping, generally the umbilical cord is not clamped or cut until 3 to 5 minutes after birth when pulsations have ceased, or until after the placenta is delivered. Delayed cord clamping provides a necessary blood volume for the transition to life outside the womb for the baby.

Currently, the facilitation of delayed cord clamping and performing simple resuscitations is an expensive and complicated procedure. Delayed cord clamping is becoming the "standard of care" in labor and delivery; however, one disadvantage is the relatively short length of the baby's umbilical cord which could inhibit positioning the baby on a secure surface for resuscitation during delayed cord clamping during a C-section birth.

Moreover, it is desirable to use the same bed for a newborn from its birth in a delivery room to other secure surfaces or until discharge to avoid repeated transfers of the patient to reduce certain risks to the safety and health of the newborn.

Furthermore, maintaining a positioning of a platform into proximity of the patient and the newborn is generally difficult due to the presence of the medical personnel, the patient, and equipment concentrated into the limited and sterile space around the operating table.

What is needed are inexpensive and more effective devices and method to offer delayed cord clamping to newborn infants and reduced transfers of the newborn.

BRIEF SUMMARY OF THE INVENTION

A delayed cord-clamping newborn utility cart assembly is provided that includes a newborn support platform having a recessed surface configured to support and position a newborn in proximity to the mother immediately after giving birth. The mother may have undergone a C-section surgical procedure or the newborn may have been delivered conventionally (trans-vaginally) in which the newborn baby may be positioned upon the newborn platform allowing for the umbilical cord to remain connected between the newborn and the mother for draining from the placenta. Examples of some delayed cord-clamping assemblies are described in further detail in PCT/US2016/052855 filed Sep. 21, 2016 (published as WO 2017/053406 and designating the U.S.), which is incorporated herein by reference in its entirety.

The newborn utility cart assembly, in one variation, may have a newborn platform which is configured to have multiple degrees of freedom such that the newborn platform may be positioned in any number of configurations relative to the patient and physician without interference while enabling delayed cord clamping. The utility cart assembly may be comprised generally of a platform portion having the newborn platform and which may be supported at its base which allow for the platform portion to be easily moved. The platform portion may be coupled to a base portion via a connecting structure and the platform portion may be actuated or controlled via controls which may be activated, e.g., by one or more pedals, to actuate or control functions such as locking, releasing, raising, lower, rotating, etc. the newborn platform. The base portion may also be supported by, e.g., a wheeled support which allows for the base portion to be moved about relative to the platform portion. The base portion may house or incorporate any number of accessories or equipment, e.g., oxygen tanks, heaters, etc., which may be used in support of the newborn, patient, and/or physician. The base portion may also incorporate other supporting structures such as an IV pole which may also be used to support other accessories or components such as a controller or monitor or other devices, e.g., scale, pulse oximetry sensor, or other physiologic monitoring devices, etc.

Because the base portion may be separated at a distance from the platform portion via the connecting structure, a space may be provided between the two portions for the physician or other medical personnel to stand in-between while allowing for the platform portion to be positioned directly next to the bed. The newborn platform may then be rotated for positioning directly over the patient and into direct proximity of the surgical site and/or birth canal for receiving the newborn. Additionally, the size of the features and instruments on the platform portion may be minimized to reduce the number of components in proximity to the patient and/or newborn. With the base portion separated at a distance, the base portion may remain outside of the sterile field around the patient while the platform portion may remain within the sterile field.

The newborn utility cart assembly may utilized as a stand-alone assembly where the platform may remain attached to the assembly rather than being detachable for transferring the newborn. Furthermore, the assembly may be optionally used with a separate docking station which may remain stationary, e.g., for providing a secure storage location for the assembly as well as to provide a power supply for charging or recharging any on-board accessories. Additionally, other variations of the utility cart assembly may incorporate an on-board power supply which may be used to supply power to the various accessories or to the newborn platform as well. Moreover, the docking station may also be used to transfer and/or store any information or data collected by one or more sensors which may be integrated or used with the assembly where the collected information or data may be transferred to another computer or server, if desired, for analysis. Data may also be communicated wirelessly to a computer or smart device such as a smart phone or pad.

The newborn utility cart assembly is configured to have multiple degrees of freedom to enable any number of configurations in order to allow for the positioning of the newborn platform into direct proximity to the desired location over the patient for receiving the newborn. For example, the platform portion may be coupled to a supporting column via a positioning arm. The newborn platform may be coupled to a distal end of the positioning arm via a coupling configured to enable the pivoting and/or rotating movement of the platform relative to the positioning arm. The positioning arm itself may be configured to have various lengths and cross-sectional shapes. For example, the positioning arm may also be configured to be flexible with lockable arms using ball-and-socket style mechanisms or the arm may include a counter-balance mechanism.

In one variation, the coupling may allow for the platform to rotate about a first axis of rotation relative to the distal end of the positioning arm. A proximal end of the positioning arm may be likewise attached to the supporting column via a coupling which may allow for the positioning arm and platform to rotate about a second axis of rotation relative to the supporting column. The second axis of rotation may allow for the rotational positioning of the platform relative to the platform portion and the patient while the first axis of rotation may allow for the finer rotational adjustment of the platform relative to the platform portion and the patient. The entire platform portion may be further rotated about a third axis of rotation defined by the base portion to further enable the adjustment of the platform relative to the patient, for example, as swiveling casters may permit the base to be positioned and oriented relative to the patient.

The first axis of rotation may define a first plane of rotation and the second axis of rotation may accordingly define second plane of rotation and the third axis of rotation may likewise define a third plane of rotation as well. The platform may also define a plane of rotation about the longitudinal axis where the plane of rotation may be transverse relative to the first plane of rotation about axis or rotation. Each of the first, second, and third planes of rotation may be defined parallel with one another or one or more of these planes of rotation may be angled relative to one another as well. Moreover, each of the planes of rotation, such as the first and second planes of rotation, may be adjustable relative to one another as the height of the platform is adjusted.

In addition to the rotational axes, the platform may be further adjusted by allowing for rotation about a longitudinal axis of the newborn platform as well as adjustment by an angle of rotation or elevation about the coupling. The platform may be rotated about the longitudinal axis or angled at a positive or negative angle of elevation relative to the longitudinal axis to optimally position the platform relative to the patient for receiving and supporting the infant. Additionally and/or optionally, the platform may be translated in a distal and/or proximal direction of longitudinal travel relative to the coupling and positioning arm. Furthermore, the platform may also be additionally and/or optionally adjusted to vary its height in a direction of elevational travel relative to the supporting column and the patient.

Any of the mechanisms on the assembly may be adjusted by moving the components to a desired configuration manually. Alternatively, one or more of the mechanisms on the assembly may be mechanically driven, e.g., via motors, where the user may control the positioning of the platform via an interface. The platform may be accordingly configured through computer control to desirably position the platform. Alternatively, the movement and positioning of the platform may be computer controlled to automate the platform movement to one of several pre-programmed configurations or the platform may be computer controlled to automatically position the platform relative to the patient, e.g., via proximity sensors, accelerometers, etc. such that the positioning members and platform 42 may function as a computer-controlled robotic arm. The motors may be configured to include any number of features such as mechanical lock-outs, predefined positions, detented guided incremental positioning, variation drag features, etc.

Turning now to the newborn platform itself, the platform may be configured to present a supporting region for receiving the newborn with an enclosing wall surrounding and defining the supporting region. The supporting wall may be relatively lower and padded at the receiving end of the platform. The platform may optionally incorporate a slide rail or mechanism which is attached to the platform and to the coupling to enable the platform to translate via the slide rail or mechanism longitudinally relative to the coupling. The surfaces of the platform may be cleanable and may also incorporate antimicrobial features. Additionally, any number of warming features, such as chemically-induced warming, infrared radiation, electrically-resistive heating, etc. may be used in combination with the platform. The surfaces which the newborn contacts may be a relatively softer material to provide cushioning.

The coupling attaching the platform to the positioning arm may be configured to be securely attached between the two or the coupling may be detachable such that the platform may be removably attached to the arm. The interface may be keyed to allow only for the attachment to the platform but in other variations, the interface for the coupling may be standardized to allow for the attachment of other instruments or accessories to the arm.

In yet other variations, the assembly may be configured to incorporate two or more separate platforms as part of a single assembly. Multiple corresponding positioning arms may be used for each of the platforms or a single positioning arm may incorporate the multiple platforms. The integration of multiple platforms may be used to receive, e.g., multiple infants such as twins, or one platform may be used for receiving the newborn while the remaining platform may be used to hold or support other instruments.

In yet another variation where the platform may incorporate a cover or enclosure which may fully or partially enclose the platform. The cover or enclosure may be configured as a removable or partially removable enclosure sized to provide enough room within the defined enclosure for a newborn infant. Moreover, the cover or enclosure may be comprised of a rigid material or a flexible material configured to collapse or retract automatically or manually. The use of the cover or enclosure may also allow for the interior of the platform to be pressurized, e.g., to function as a hyperbaric enclosure, or potentially cooled, e.g., for transporting organs, or heated to maintain newborn body temperature.

Another variation may have the interior of the platform optionally integrating one or more sensors or detectors. The sensors or detectors may include a number of different types of sensors or detectors, e.g., cameras (imaging, infrared, etc.), microphones, etc. which may be used to detect or monitor any number of parameters of the infant. For example, the sensors or detectors may be used to detect and/or monitor physiologic parameters such as movement, auditory signals, respiratory rate, heart rate, etc. Moreover, the sensors or detectors may be optionally linked (wired or wirelessly) with an onboard or remote computer or server for collecting and/or analyzing the captured information. Another feature of the platform may include one or more lights (e.g., visible, infrared, ultraviolet, etc.) positioned around the platform as well.

Aside from the movement of the platform itself, the connecting structure between the platform portion and base portion may also be configured into alternative structures to provide additional flexibility in optimally adjusting the position of platform. For example, the connecting structure may optionally be a parallelogram that provides vertical adjustment of the platform, or a robotic arm with two or more arm sections and rotary joints to provide desired vertical and horizontal positioning and orientation of the platform.

In yet another variation, any of the various embodiments described herein may incorporate one or more shelves or trays which may be attached to the assembly for providing space for storage of various items. Other variations may incorporate a single shelf or multiple shelves attached to either the pole or another feature of the assembly, for example, beneath the platform for ready accessibility. Other variations of the assembly may also incorporate an on-board display or monitor attached directly to the assembly. This variation as well as any of the features described herein may be used in combination with any other features, as desirable.

In one variation, the utility cart assembly may generally comprise a platform configured to receive and support a newborn, a positioning arm having a distal end coupled to the platform, and a supporting column coupled to a proximal end of the positioning arm. The platform may be at least partially rotatable about a first axis of rotation between the platform and the positioning arm. Furthermore, the positioning arm is at least partially rotatable about a second axis of rotation between the positioning arm and the support column.

In another variation, the utility cart assembly may generally comprise a platform portion having a platform supported via a positioning arm coupled to a supporting column and a base portion attached to the platform portion via a connecting structure. The platform may be at least partially rotatable about a first axis of rotation, and the positioning arm may be at least partially rotatable about a second axis of rotation. Furthermore, the assembly may be at least partially rotatable about a third axis of rotation.

In yet another variation, one method of positioning a utility cart assembly relative to a patient may generally comprise positioning a platform portion of the utility cart assembly adjacent to the patient, the platform portion having a platform supported via a positioning arm coupled to a supporting column and rotating the platform about a first axis of rotation. Furthermore, the positioning arm may be rotated about a second axis of rotation such that the platform is positioned into proximity to the patient.

DETAILED DESCRIPTION OF THE INVENTION

The newborn utility cart assembly described may be used for facilitating delayed clamping of the newborn umbilical cord when delivered trans-vaginally in a labor and delivery room and/or surgically in an operating room such as during a C-Section birth. The newborn utility cart assembly may additionally and/or alternatively be used for facilitating simple resuscitations upon a newborn. The utility cart assembly may be positioned in proximity to the lap of the mother or in proximity to the surgical region, or wound site, so that when the baby is born he/she is easily transferred to a supporting platform surface, e.g., for 1-2 minutes, while blood transfers to the baby through the still-attached umbilical cord prior to clamping and cutting. Since the average umbilical cord is about 50 cm in length, a newborn utility cart assembly allows for close support of the newborn whereas an adjacent table may be too far removed from the mother.

Figure 1A:
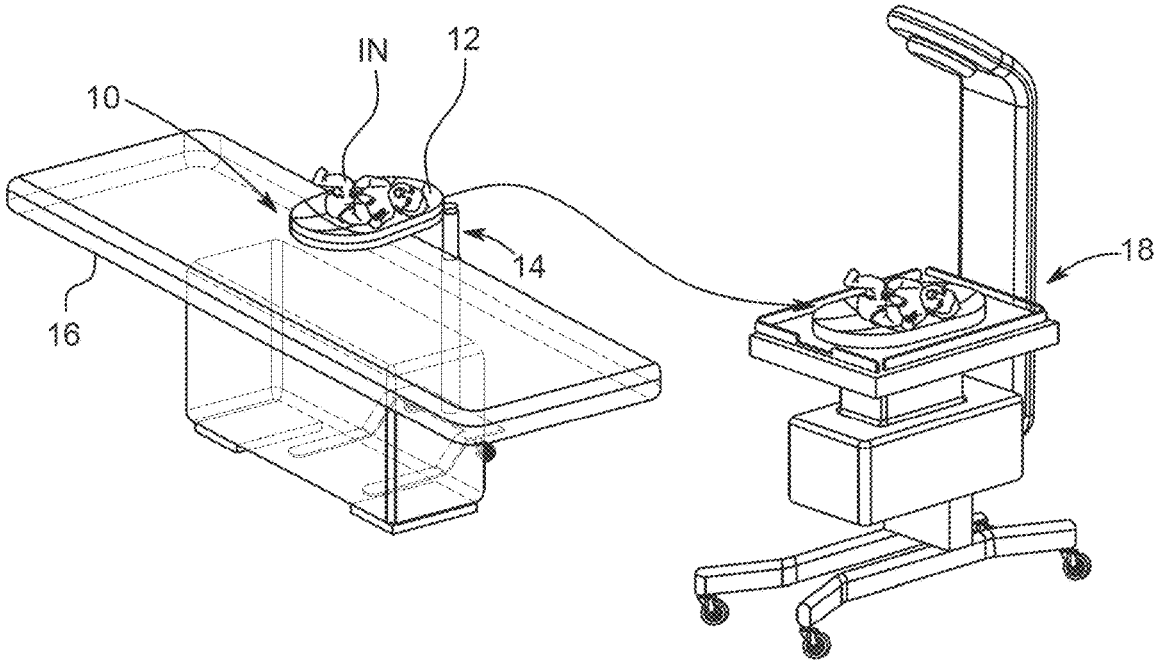
FIGS. 1A to 1C show examples of the newborn platform and warming table.
Figure 1B:
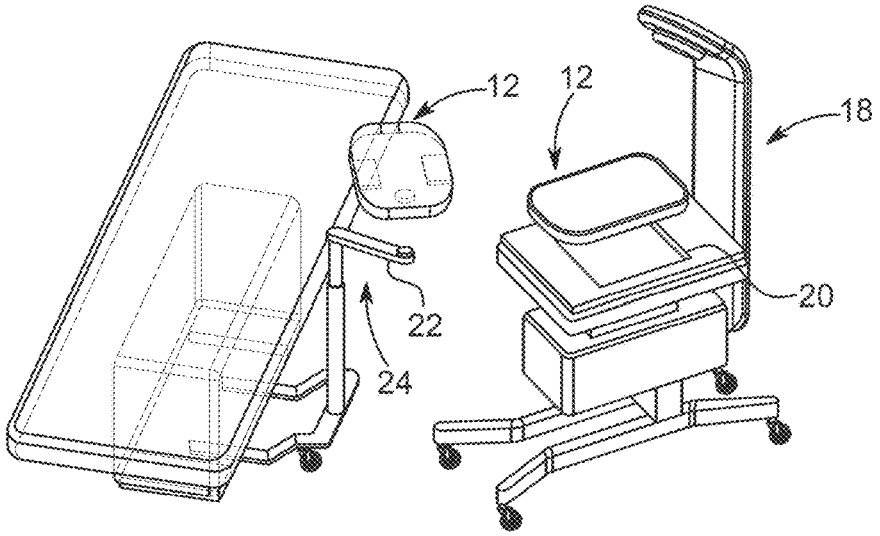
Figure 1C:
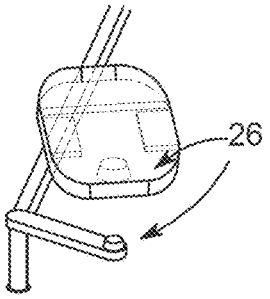

As shown in FIGS. 1A-1C, perspective views of one example of a newborn platform 10 and warming table 18 are illustrated where FIG. 1A shows the newborn platform 12 attached to a detachable platform assembly 14, which is represented as a moveable cart positioned adjacent to a surgical bed 16. Also shown is a newborn IN placed on the newborn platform 12. FIG. 1B shows the newborn platform 12 in a detached state from the articulating arm 22 of the detachable platform support 24 and positioned for placement in the mount 20 of the warming table 18. FIG. 1C shows a perspective top view of the connection 26 of the newborn platform 12 with the detachable platform support, where the connection 26 can be, e.g., frictional fit, indexed male-female fitting, latched, magnetic mounting, etc., or any combination thereof.

Figure 2:
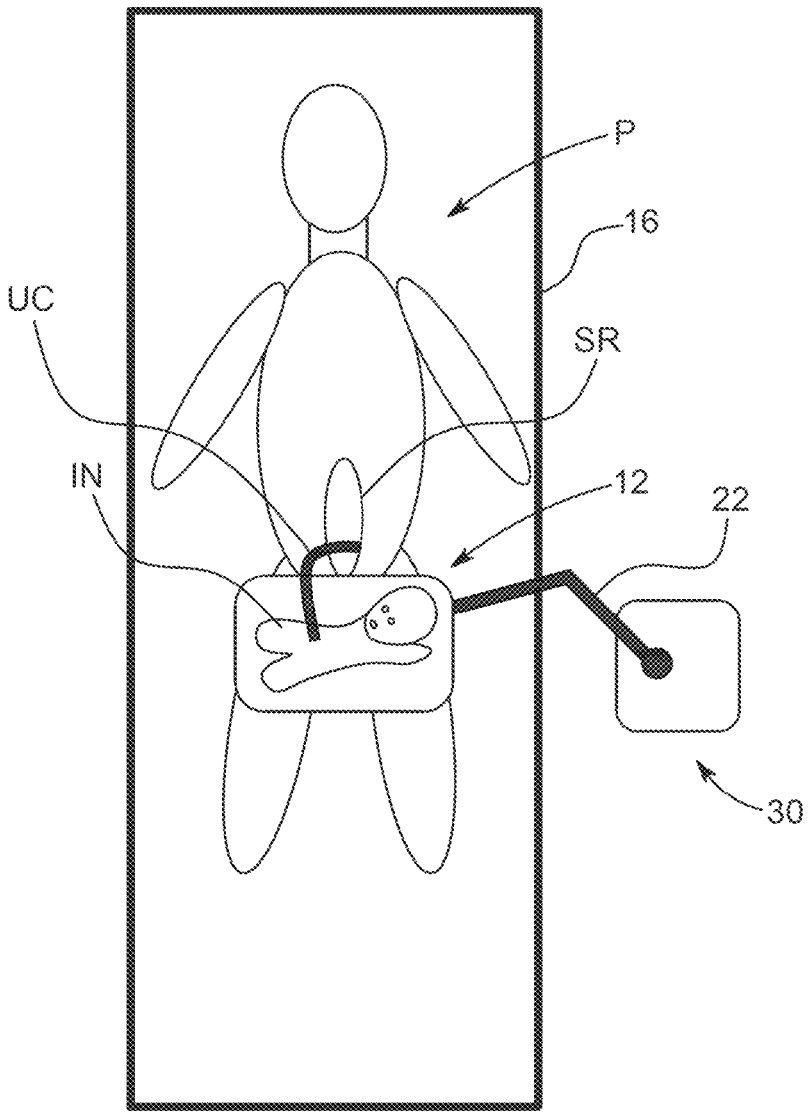
FIG. 2 shows a schematic view of a C-section patient having a newborn platform positioned near the surgical region, where the umbilical cord remains attached to the placenta for draining before delayed clamping.

FIG. 2 shows a schematic view of another embodiment of a patient P having the newborn platform 12 position in proximity to the surgical region SR, where the umbilical cord UC remains attached between the newborn IN and the placenta for draining before delayed clamping. The newborn platform 12 is shown supported by the articulating arm 22 of the detachable platform support 30. Examples of some delayed cord-clamping assemblies are described in further detail in PCT/US2016/052855 filed Sep. 21, 2016 (published as WO 2017/053406 and designating the U.S.), which is incorporated herein by reference in its entirety.

Figure 3A:
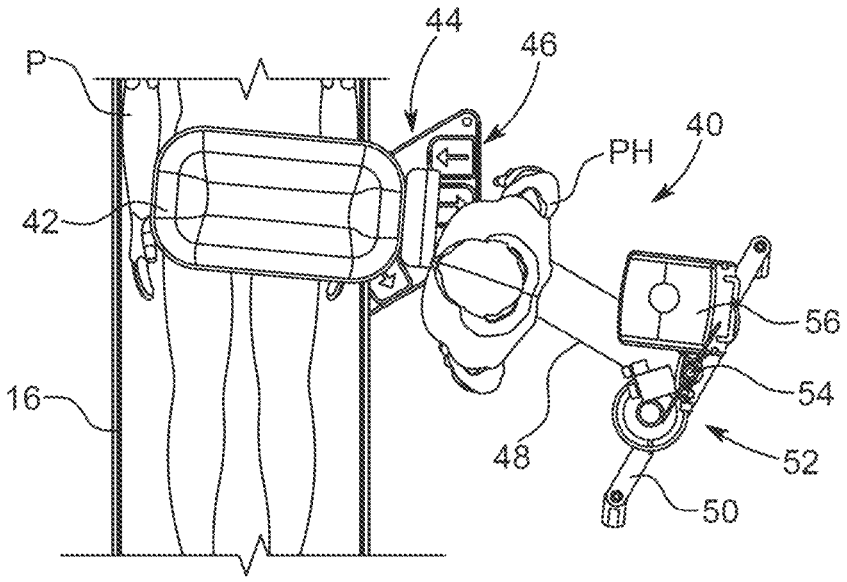
FIGS. 3A and 3B show top and perspective schematic views of another variation of the newborn utility cart assembly positioned in a transverse configuration relative to a patient who is to deliver a newborn.
Figure 3B:
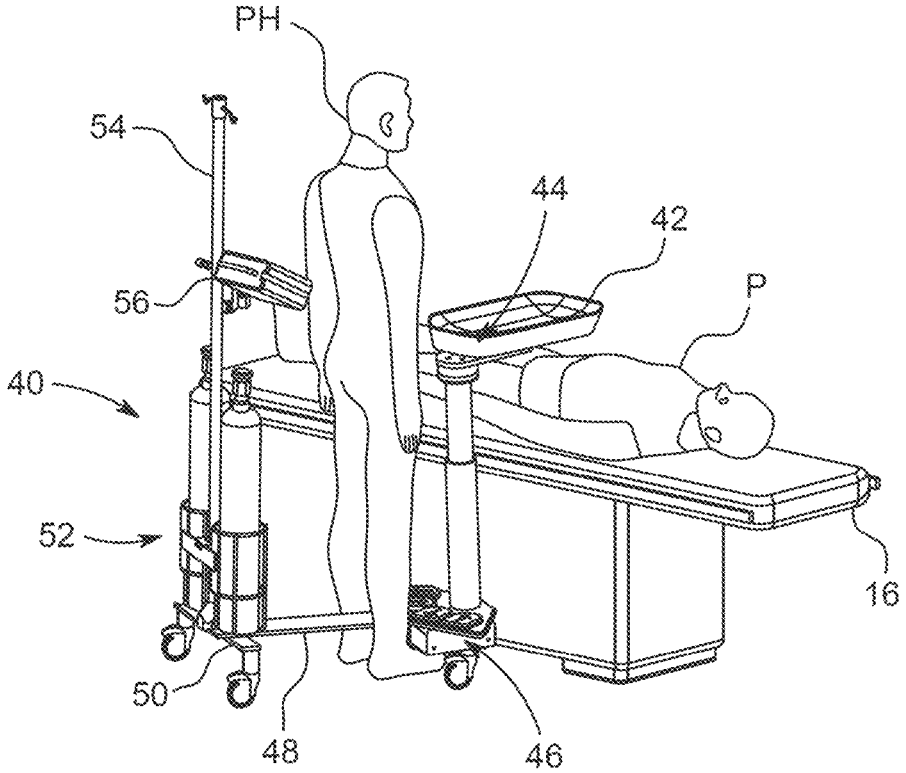

FIGS. 3A and 3B show top and perspective views of another variation of the newborn utility cart assembly 40 having a newborn platform 42 which is configured to have multiple degrees of freedom such that the newborn platform 42 may be positioned in any number of configurations relative to the patient P and physician PH without interference while enabling delayed cord clamping. In this example, the newborn platform 42 is shown as being positioned to extend over the patient so that a longitudinal axis of the platform 42 extends transversely (or generally in a transverse position) relative to the patient P. The platform 42 may, of course, be positioned in any number of configurations relative to the patient P depending on the procedure being performed and/or the preferences of the physician PH. The utility cart assembly 40 may be comprised generally of a platform portion 44 having the newborn platform 42 and which may be supported at its base by, e.g., supports or wheels (lockable or free) which allow for the platform portion 44 to be easily moved. The platform portion 44 may be coupled to a base portion 52 via a connecting structure 48 and the platform portion 44 may be actuated or controlled via controls 46 which may be activated, e.g., by one or more pedals or hand controls, to actuate or control functions such as locking, releasing, raising, lowering, rotating, etc. the newborn platform 42. The base portion 52 may also be supported by, e.g., supports or wheels which allow for the base portion 52 to be moved about relative to the platform portion 44 as well. The base portion 52 may house or incorporate any number of accessories or equipment, e.g., oxygen and hospital air tanks, heaters, etc., which may be used in support of the newborn IN, patient P, and/or physician PH. The base portion 52 may also incorporate other supporting structures such as an IV pole 54 which may also be used to support other accessories or components such as a controller or monitor 56 or other devices, e.g., $O_2$ and air mixers, resuscitators such as the Neopuff® infant resuscitator (Fisher & Paykel Ltd., Auckland, New Zealand), scale, pulse oximetry sensor, or other physiologic monitoring devices, etc.

Additionally, the pole 54 may further incorporate a handle that may be secured to the pole 54 with a sterile cover that can connect to any pole. Such a handle may be used to control the base portion 52 position and could be used remotely. Further details of an example of such a handle are described herein below.

Because the base portion 52 may be separated at a distance from the platform portion 44 via connecting structure 48, a space may be provided between the two portions for the physician PH or other medical personnel to stand in-between while allowing for the platform portion 44 to be positioned directly next to the bed 16. The newborn platform 42 may then be rotated for positioning directly over the patient P and into direct proximity of the surgical site and/or birth canal for receiving the newborn IN. Additionally, the size of the features and instruments on the platform portion 44 may be minimized to reduce the number of components in proximity to the patient P and/or newborn IN. With the base portion 52 separated at a distance, the base portion 52 may remain outside of the sterile field around the patient P while the platform portion 44 may remain within the sterile field.

Figure 3C:
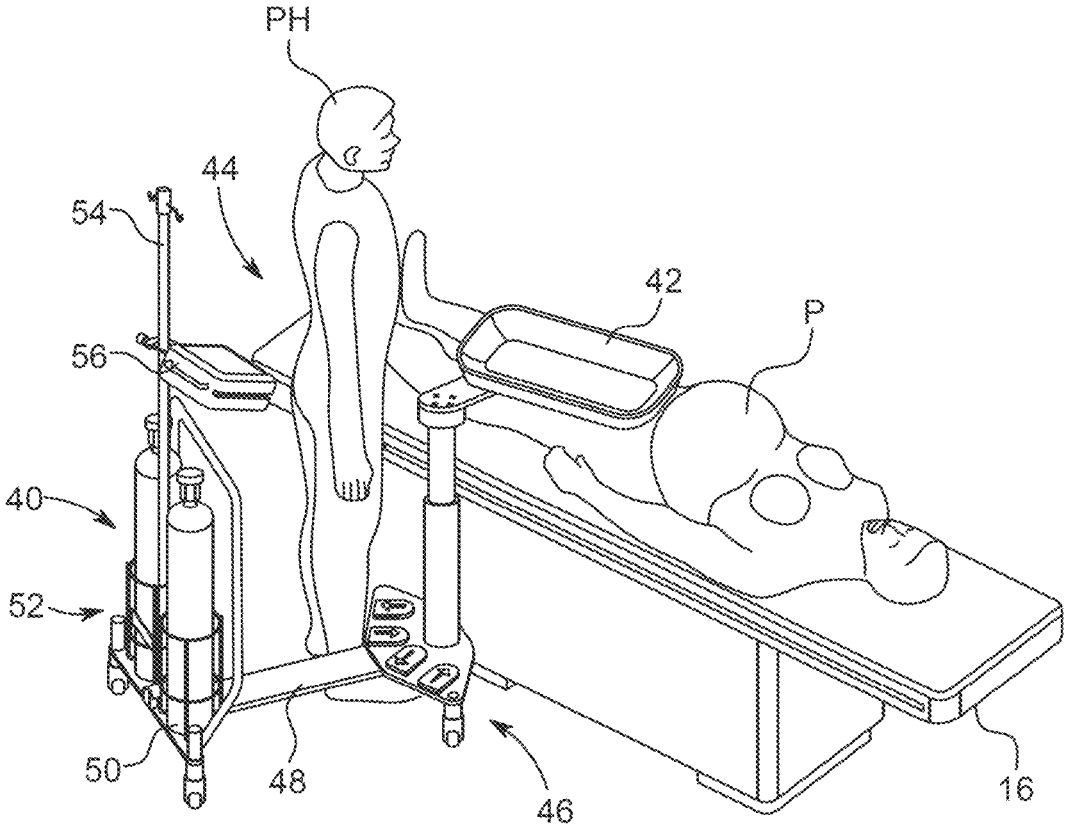
FIG. 3C shows a perspective view of another variation where the newborn platform may be positioned in a parallel configuration relative to the patient.

FIG. 3C shows a perspective view of another variation where the newborn platform 42 may be positioned over or in proximity to the patient P such that the longitudinal axis of the platform 42 extends in parallel (or generally in a parallel position) with the patient P positioned upon the platform 16. This parallel configuration of the platform 42 relative to the patient P may be utilized for any number of procedures, such as a C-section, although the platform 42 may be optionally configured in any number positions relative to the patient P, if so desired.

The newborn utility cart assembly 40 may be utilized as a stand-alone assembly where the platform 42 may remain attached to the assembly 40 rather than being detachable for transferring the newborn. Furthermore, the assembly 40 may be optionally used with a separate docking station which may remain stationary, e.g., for providing a secure storage location for the assembly 40 as well as to provide a power supply for charging or recharging any on-board accessories. Additionally, other variations of the utility cart assembly 40 may incorporate an on-board power supply which may be used to supply power to the various accessories or to the newborn platform 42 as well. Moreover, the docking station may also be used to transfer and/or store any information or data collected by one or more sensors which may be integrated or used with the assembly 40 where the collected information or data may be transferred to another computer or server, if desired, for analysis. Further details of such a docking station are described in further detail below.

Figure 4:
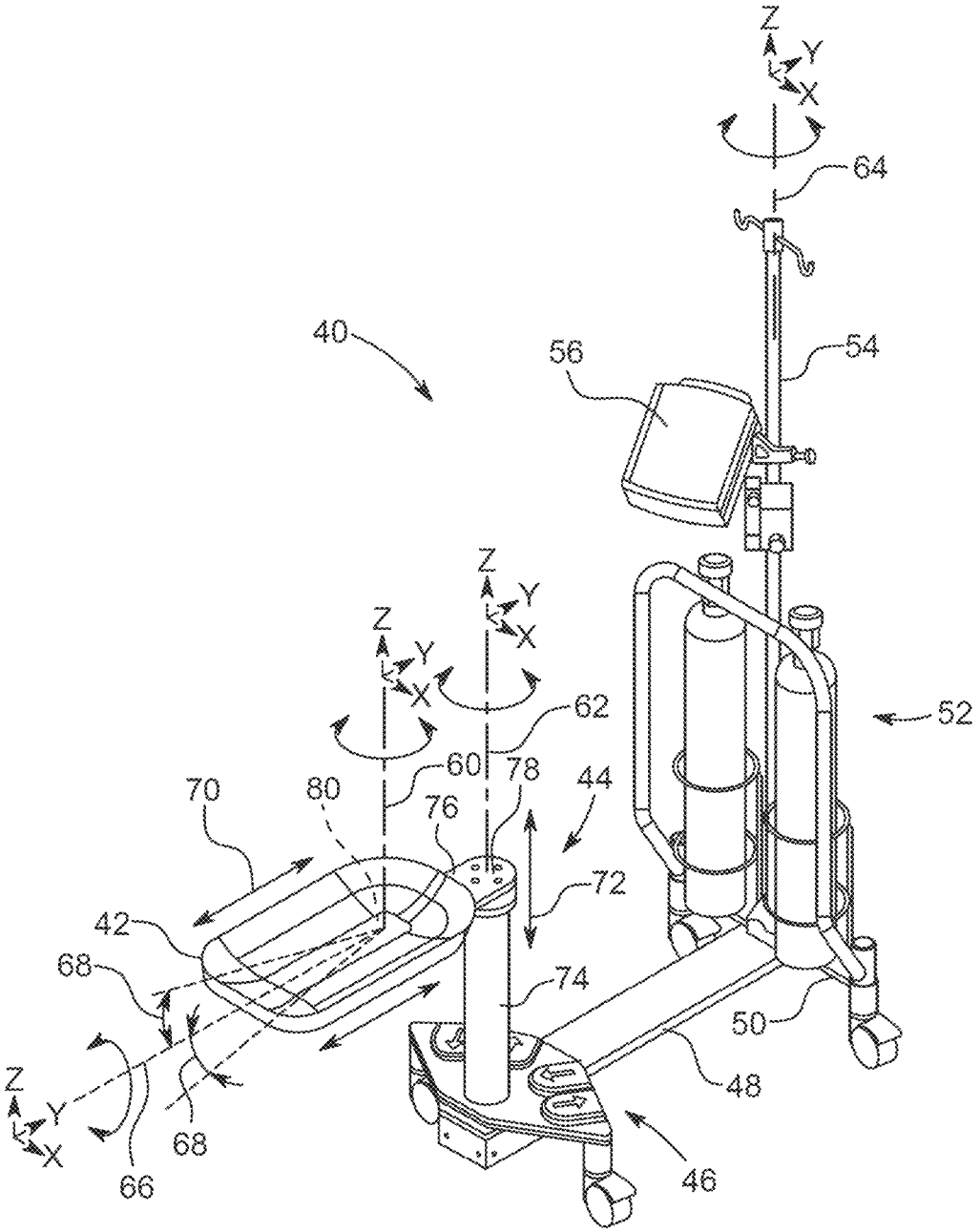
FIG. 4 shows a perspective view of another variation of the newborn utility cart assembly illustrating the multiple degrees of freedom in which the platform may be positioned.

The newborn utility cart assembly 40 is configured to have multiple degrees of freedom to enable any number of configurations in order to allow for the positioning of the newborn platform 42 into direct proximity to the desired location over the patient P for receiving the newborn IN. FIG. 4 shows a perspective view of one variation of the utility cart assembly 40 to illustrate the possible configurations. For example, the platform portion 44 is shown with the newborn platform 42 which may be coupled to a supporting column 74 via a positioning arm 76. The newborn platform 42 may be coupled to a distal end of the positioning arm 76 via a coupling 80 configured to enable the pivoting and/or rotating movement of the platform 42 relative to the positioning arm 76. The positioning arm 76 itself may be configured to have various lengths and cross-sectional shapes. For example, the positioning arm 76 may also be configured to be flexible with lockable arms using ball-and-socket style mechanisms or the arm may include a counter-balance mechanism.

In one variation, the coupling 80 may allow for the platform 42 to rotate about a first axis of rotation 60 relative to the distal end of the positioning arm 76, as illustrated. A proximal end of the positioning arm 76 may be likewise attached to the supporting column 74 via a coupling 78 which may allow for the positioning arm 76 and platform 42 to rotate about a second axis of rotation 62 relative to the supporting column 74, as illustrated. The second axis of rotation 62 may allow for the rotational positioning of the platform 42 relative to the platform portion 44 and the patient P while the first axis of rotation 60 may allow for the finer rotational adjustment of the platform 42 relative to the platform portion 44 and the patient P. The entire platform portion 44 may be further rotated about a third axis of rotation 64 defined by the base portion 52 to further enable the adjustment of the platform 42 relative to the patient P.

The first axis of rotation 60 may define a first plane of rotation, as noted, and the second axis of rotation 62 may accordingly define second plane of rotation, as noted, and the third axis of rotation 64 may likewise define a third plane of rotation as well. The platform 42 may also define a plane of rotation about the longitudinal axis 66 where the plane of rotation may be transverse relative to the first plane of rotation about axis or rotation 60. Each of the first, second, and third planes of rotation may be defined parallel with one another or one or more of these planes of rotation may be angled relative to one another as well. Moreover, each of the planes of rotation, such as the first and second planes of rotation, may be adjustable relative to one another as the height of the platform 42 is adjusted.

In addition to the rotational axes, the platform 42 may be further adjusted by allowing for rotation about a longitudinal axis 66 of newborn platform 42 as well as adjustment by an angle of rotation or elevation 68 about coupling 80. The platform 42 may be rotated about longitudinal axis 66 or angled in a positive or negative angle of elevation 68 relative to the longitudinal axis 66 to optimally position the platform 42 relative to the patient P for receiving and supporting the infant IN. Additionally and/or optionally, the platform 42 may be translated in a distal and/or proximal direction of longitudinal travel 70 relative to coupling 80 and positioning arm 76. Furthermore, the platform 42 may also be additionally and/or optionally adjusted to vary its height in a direction of elevational travel 72 relative to the supporting column 74 and the patient P.

Any of the mechanisms on the assembly 40 may be adjusted by moving the components to a desired configuration manually. Alternatively, one or more of the mechanisms on the assembly 40 may be mechanically driven, e.g., via motors, where the user may control the positioning of the platform 42 via an interface such as controls 46 or controller or monitor 56 or another interface such as a resuscitation apparatus. One example of a resuscitation apparatus may include the Neopuff® infant resuscitator, as described above. The platform 42 may be accordingly configured through computer control to desirably position the platform 42. Alternatively, the movement and positioning of the platform 42 may be computer controlled to automate the platform 42 movement to one of several pre-programmed configurations or the platform 42 may be computer controlled to automatically position the platform 42 relative to the patient, e.g., via proximity sensors, accelerometers, etc. such that the positioning members and platform 42 may function as a computer-controlled robotic arm. The motors may be configured to include any number of features such as mechanical lock-outs, predefined positions, detented guided incremental positioning, variation drag features, etc.

Because all of the positioning controls for the platform 42 (e.g., up/down, translations horizontally and rotationally) may be controlled from the platform itself, any number of additional configuration controls may be optionally incorporated such as the automated control of the supporting column 74. Moreover, any number of locking features may also be optionally incorporated such that the platform 42 can be maintained in a secured and locked configuration in any position and orientation. Additionally and/or alternatively, the platform 40 may also incorporate driven omni-directional wheels which allow for the platform so that it also becomes the drive and steering system.

Figure 5A:
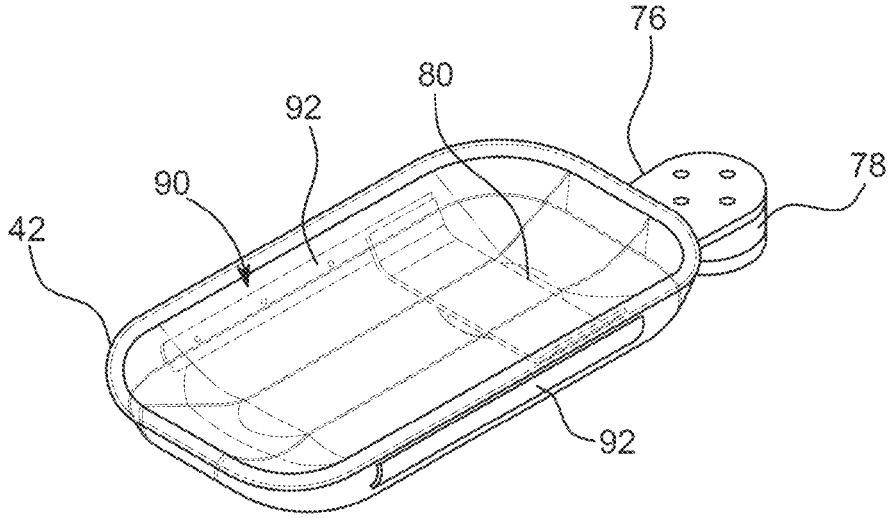
FIGS. 5A and 5B show perspective and side views of variations of the platform.
Figure 5B:
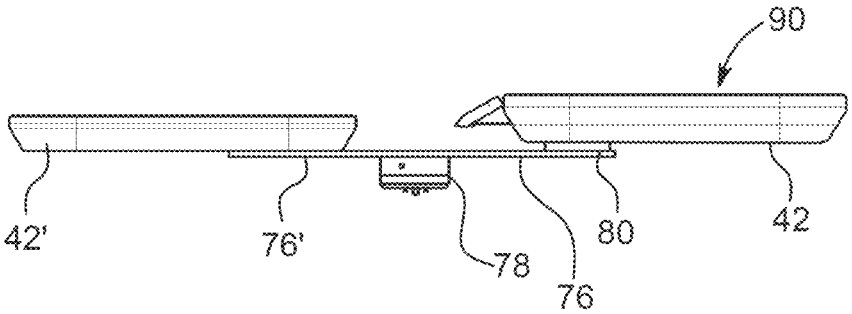

Turning now to the newborn platform 42 itself, FIG. 5A shows a perspective view of one variation of the platform 42. The platform 42 may be configured to present a supporting region 90 for receiving the newborn IN with an enclosing wall surrounding and defining the supporting region 90. The platform 42 may optionally incorporate a slide rail or mechanism 92 which is attached to the platform 42 and to the coupling 80 to enable the platform 42 to translate via the slide rail or mechanism 92 longitudinally relative to the coupling 80. The surfaces of the platform 42 may be cleanable and may also incorporate antimicrobial features. Additionally, any number of warming features, such as chemically-induced warming, infrared radiation, electrically-resistive heating, etc. may be used in combination with the platform 42. The side view of FIG. 5B shows the platform 42 attached to the positioning arm 76 via coupling 80 and also shows an alternative attachment configuration where the platform 42' may be attached directly to the positioning arm 76'. The platform height or thickness may accordingly be adjusted as needed, e.g., to minimize any hydrostatic pressure drops in the umbilical cord flow to the newborn infant IN.

The coupling 80 attaching the platform 42 to the positioning arm 76 may be configured to be securely attached between the two or coupling 80 may be detachable such that the platform 42 may be removably attached to the arm 76. The interface may be keyed to allow only for the attachment to the platform 42 but in other variations, the interface for coupling 80 may be standardized to allow for the attachment of other instruments or accessories to the arm 76.

In yet other variations, the assembly may be configured to incorporate two or more separate platforms 42 as part of a single assembly. Multiple corresponding positioning arms may be used for each of the platforms or a single positioning arm may incorporate the multiple platforms 42. The integration of multiple platforms may be used to receive, e.g., multiple infants such as twins, or one platform may be used for receiving the newborn while the remaining platform may be used to hold or support other instruments.

Figure 5C:
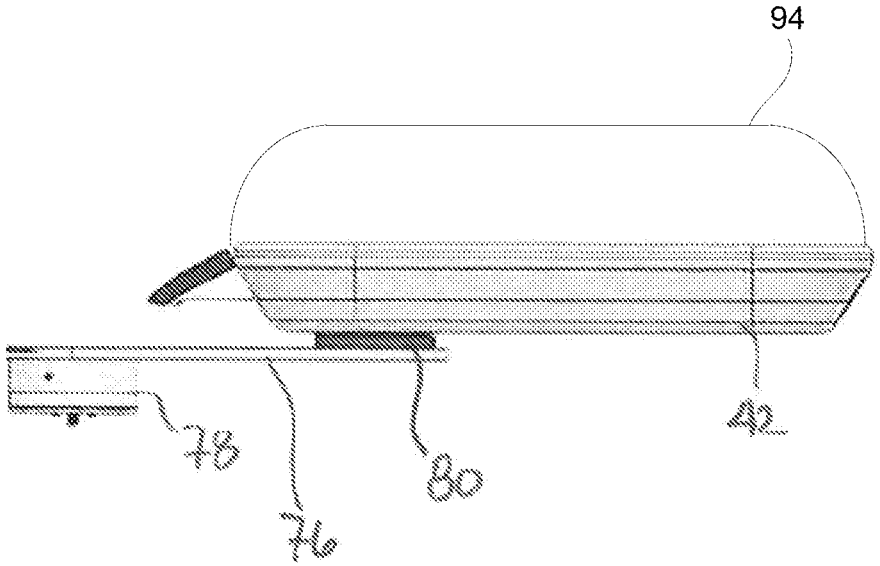
FIG. 5C shows a side view of another variation where the platform may be fully or partially enclosed.

FIG. 5C shows yet another variation where the platform 42 may incorporate a cover or enclosure 94 which may fully or partially enclose the platform 42. The cover or enclosure 94 may be configured as a removable or partially removable enclosure sized to provide enough room within the defined enclosure for a newborn infant. Moreover, the cover or enclosure 94 may be comprised of a rigid material or a flexible material configured to collapse or fold or retract automatically or manually. The use of the cover or enclosure 94 may also allow for the interior of the platform 42 to be pressurized, e.g., to function as a hyperbaric enclosure, or potentially cooled, e.g., for transporting organs, or heated to maintain newborn IN body temperature.

Figure 5D:
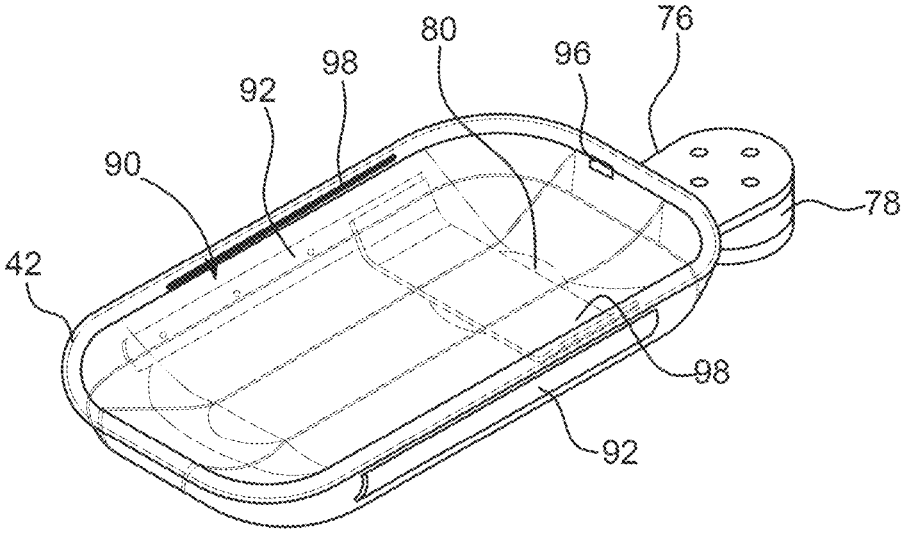
FIG. 5D shows a perspective view of another variation where the platform may incorporate one or more different monitoring sensors and/or lights.

Another variation is shown in the perspective view of FIG. 5D which shows the interior of the platform 42 optionally integrating one or more sensors or detectors 96. The sensors or detectors 96 may include a number of different types of sensors or detectors, e.g., cameras (imaging, infrared, etc.), microphones, etc. which may be used to detect or monitor any number of parameters of the infant IN. For example, the sensors or detectors 96 may be used to detect and/or monitor physiologic parameters such as movement, auditory signals, respiratory rate, heart rate, surface pressures, etc. Moreover, the sensors or detectors 96 may be optionally linked (wired or wirelessly) with an onboard or remote computer or server for collecting and/or analyzing the captured information. Another feature of the platform 42 may include one or more lights 98 (e.g., visible, infrared, ultraviolet, etc.) positioned around the platform 42 as well, to sense, heat, or illuminate.

Figure 6:
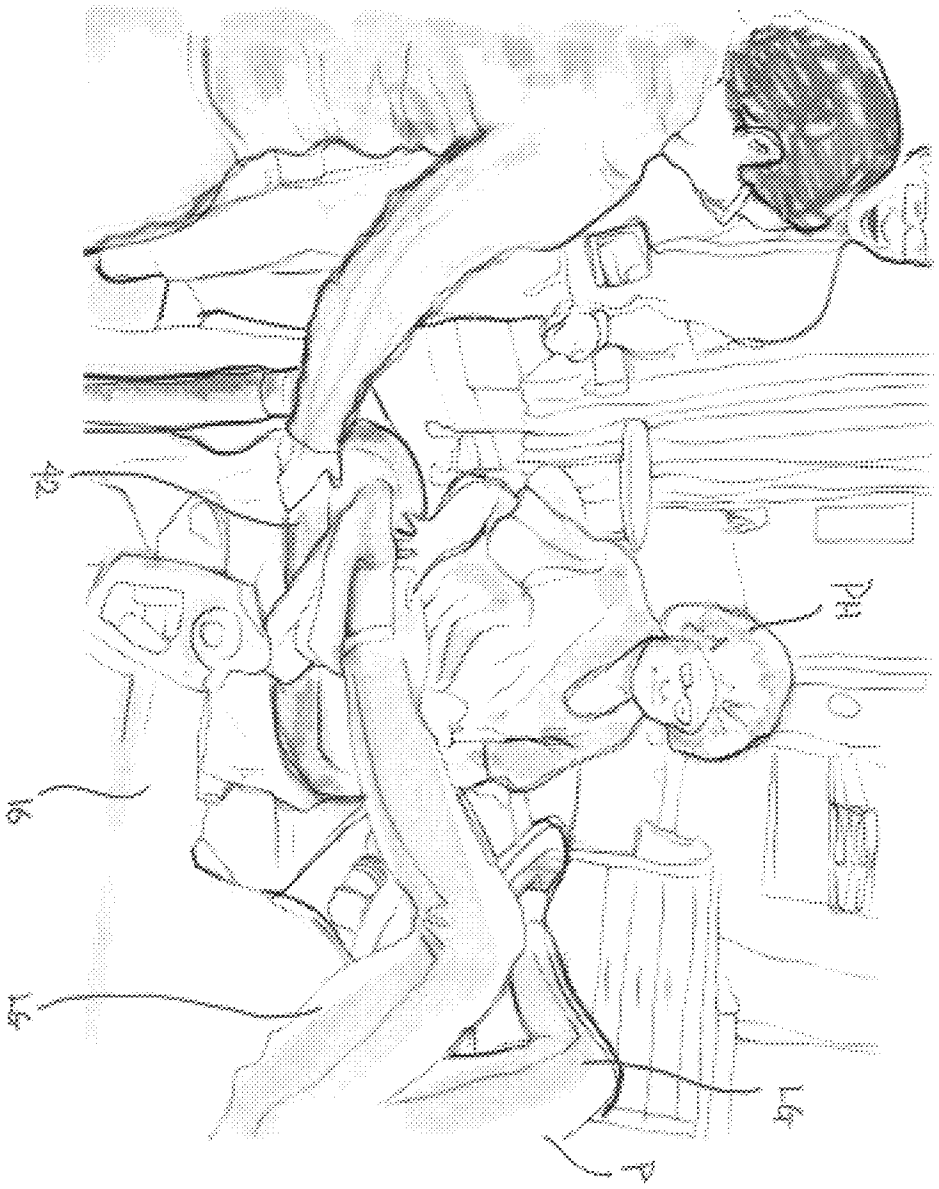
FIG. 6 shows another example of the flexibility in how the newborn utility cart assembly may be positioned relative to the patient.

Because of the multiple rotational axes and degrees of freedom provided by the utility cart assembly, the platform 42 may be positioned relative to the patient P in any number of configurations. FIG. 6 illustrates an example where the patient P may be resting upon the bed 16 with her legs LG supported up in a straddling position such as when the patient P has her legs LG supported by stirrups. The physician PH may be positioned between the legs LG of the patient P to deliver a newborn trans-vaginally. Given the limitations on space, the platform 42 may be configured or shaped accordingly to be optimally positioned adjacent to the physician PH and in direct proximity to the patient P to receive the newborn IN. The platform 42 may be accordingly positioned to extend, e.g., beneath one of the patient's legs LG, and rotated for positioning directly in proximity to the edge of the patient bed and in position between the legs LG of the patient, as shown. Alternatively, the platform 42 may be configured to extend adjacent to the physician PH to optimally position the platform 42. Other configurations may be utilized depending upon the desired position of the platform relative to the patient P and newborn IN.

Figure 7B:
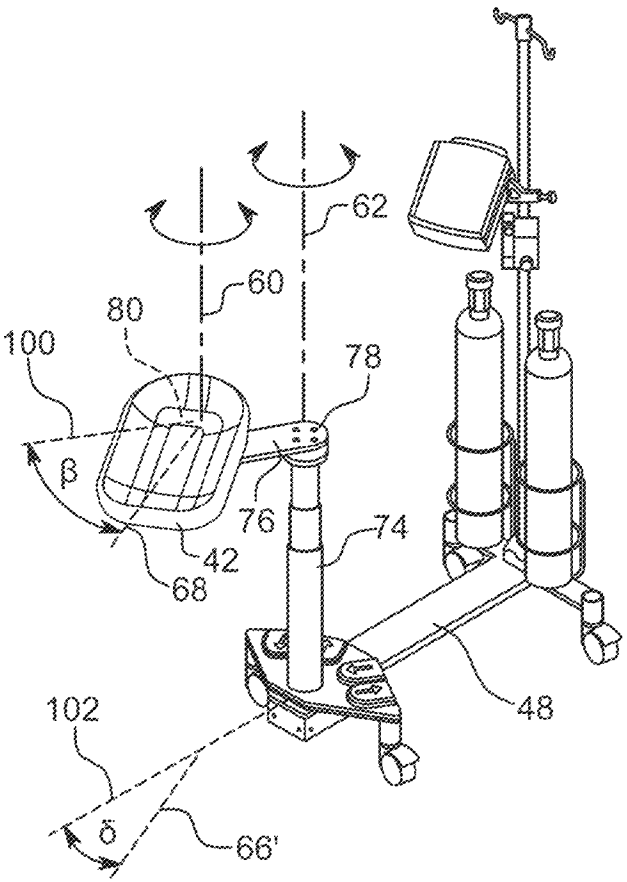
FIGS. 7A and 7B show perspective views of yet another example of how a position/orientation of the platform may be adjusted via rotation of the platform relative to the utility cart assembly.
Figure 7A:
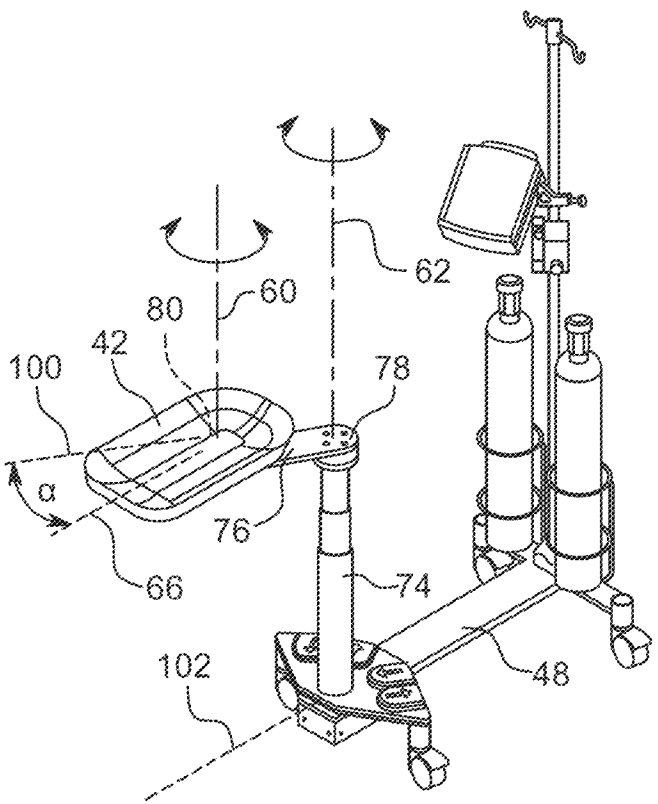

FIGS. 7A and 7B show perspective views of the assembly to illustrate another example of how the platform 42 may be rotated about its various axes of rotation. As shown in FIG. 7A, the platform 42 may be rotated about its first axis of rotation 60 via coupling 80 such that the platform 42 forms a first angle $\alpha$ between the longitudinal axis 66 of platform 42 and the longitudinal axis 100 of positioning arm 76. In this example, the longitudinal axis 66 of platform 42 may initially align with the longitudinal axis 102 of connecting structure 48. The platform 42 may be further rotated about coupling 80 to form a second angle $\beta$ between longitudinal axis 66 and 100 such that an angle $\delta$ is also formed between longitudinal axis 66' and 102, as illustrated in FIG. 7B.

Figure 8B:
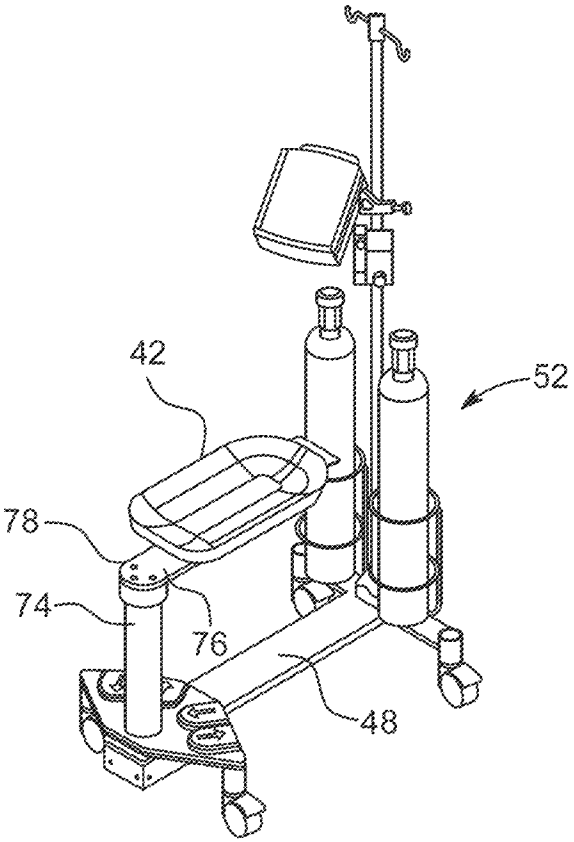
FIGS. 8A and 8B show side and perspective views of yet another example of how the platform may be positioned for transit, attending to newborn after cart is moved away from the operating table, or for storage.
Figure 8A:
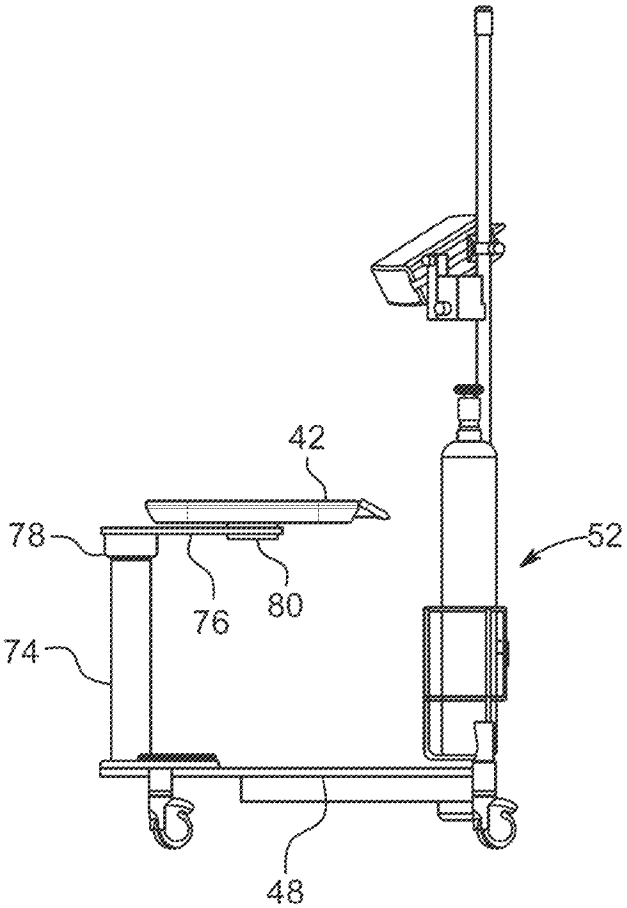

FIGS. 8A and 8B show side and perspective views of the utility cart assembly where the platform 42 may be rotated entirely about supporting column 74 such that the platform 42 is turned towards base portion 52, e.g., for cart storage, or for the transport of the newborn IN to the neonatal intensive care unit (NICU). This configuration may be used to minimize the profile of the utility cart assembly, and increase stability for longer excursions/transits.

Figure 9B:
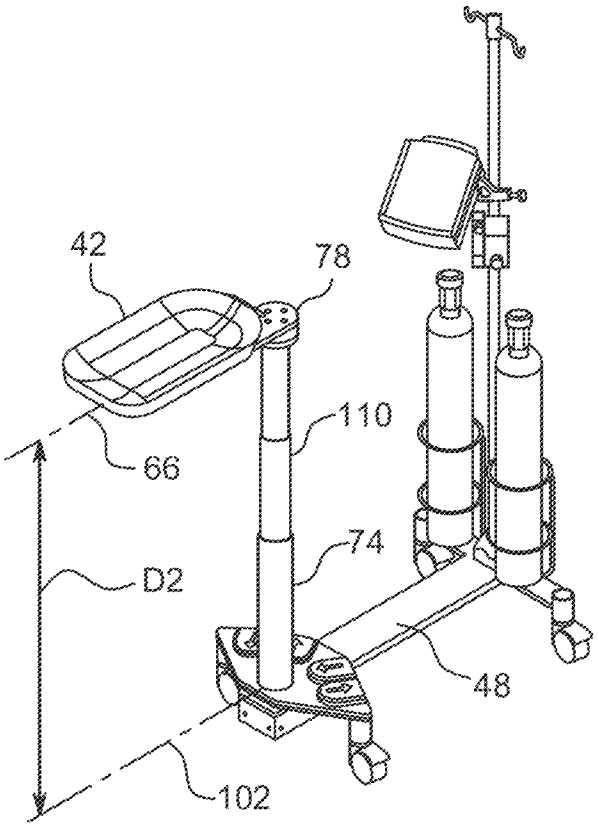
FIGS. 9A and 9B show perspective views of yet another example of how the platform may be repositioned in height.
Figure 9A:
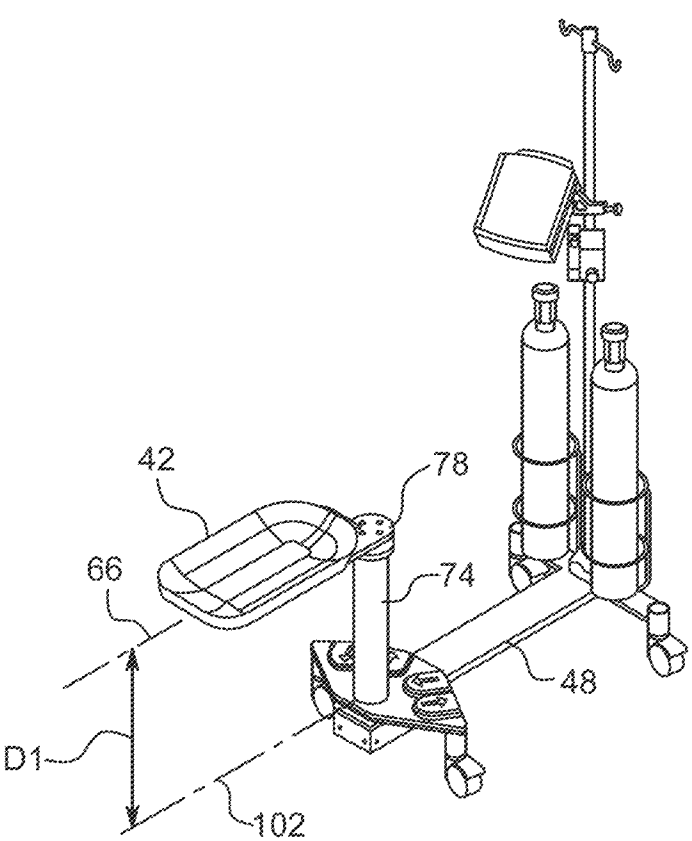

FIGS. 9A and 9B show perspective views of another example illustrating how the platform 42 may be configured into various heights relative to the remainder of the utility cart assembly. FIG. 9A shows a first configuration where the platform 42 may be positioned at an initial height D1 between the longitudinal axis 66 of platform 42 and longitudinal axis 102 of connecting structure 48. To adjust the relative height, one or more telescoping members 110 may couple between supporting column 74 and coupling 78 such that the platform 42 may be raised (or lowered) in height. FIG. 9B shows an example where platform 42 may be raised to a subsequent height D2 by extending the one or more telescoping members 100. Any number of height adjusting mechanisms may be used to adjust the height of the platform 42. The height adjustment controls may utilize up/down foot switches on the cart base, or up/down switches integrated into the platform. Such switches may be inset to help prevent accidental activation, and may have other features such as increased switch deflection may increase speed of adjustment.

Figure 10B:
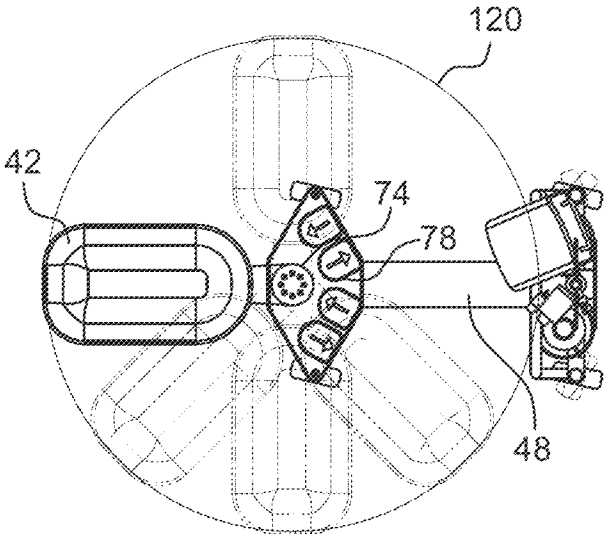
FIGS. 10A and 10B show perspective and top views of yet another example of how the platform may be rotated about an axis of rotation for repositioning.
Figure 10A:
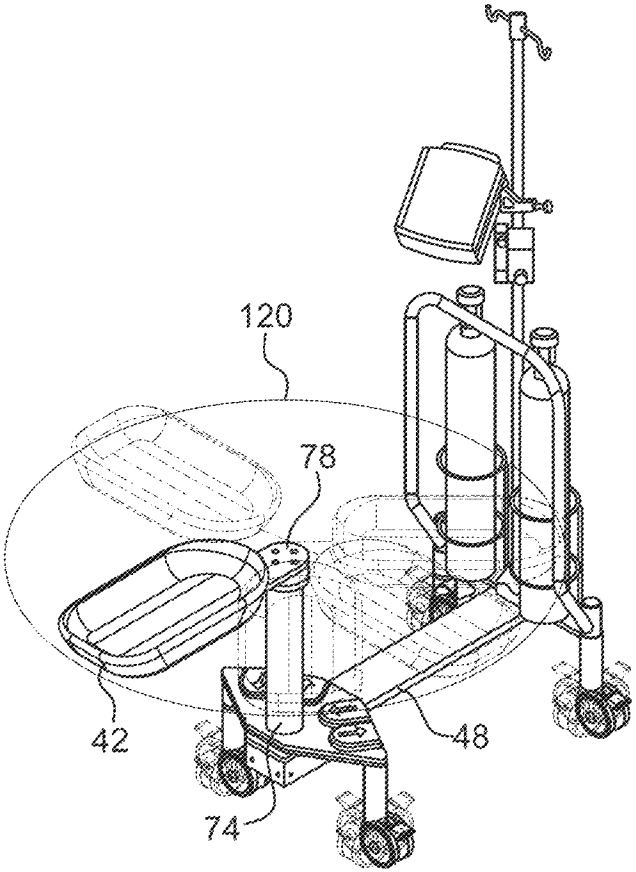

FIGS. 10A and 10B show perspective and top views of yet another example to illustrate how the platform 42 may be rotated about coupling 78. As illustrated, the positioning arm 76 and the platform 42 may be rotated completely about its second axis of rotation 62 in an unhindered manner such that the platform 42 and positioning arm 76 may be rotated in a full 360 degree arc 120 about the supporting column 74. The platform 42 may be accordingly rotated into any desired position. In other variations, the rotation of the platform 42 and positioning arm 76 may be limited, guided or constrained to rotate within a limited or predefined field or angle of rotation.

Figure 11B:
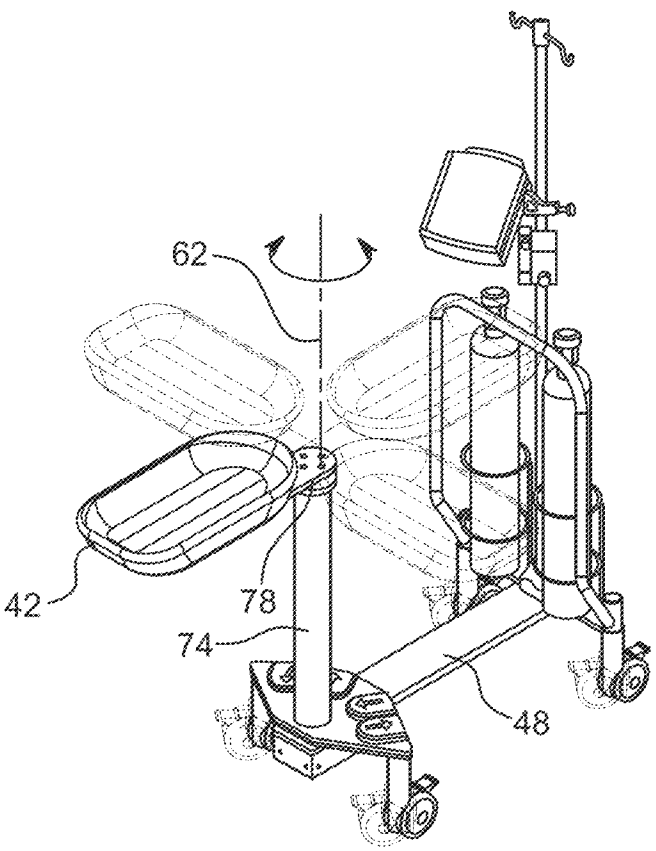
FIGS. 11A and 11B show perspective views of yet another example of how the platform may be rotated about its various axes of rotation for repositioning.
Figure 11A:
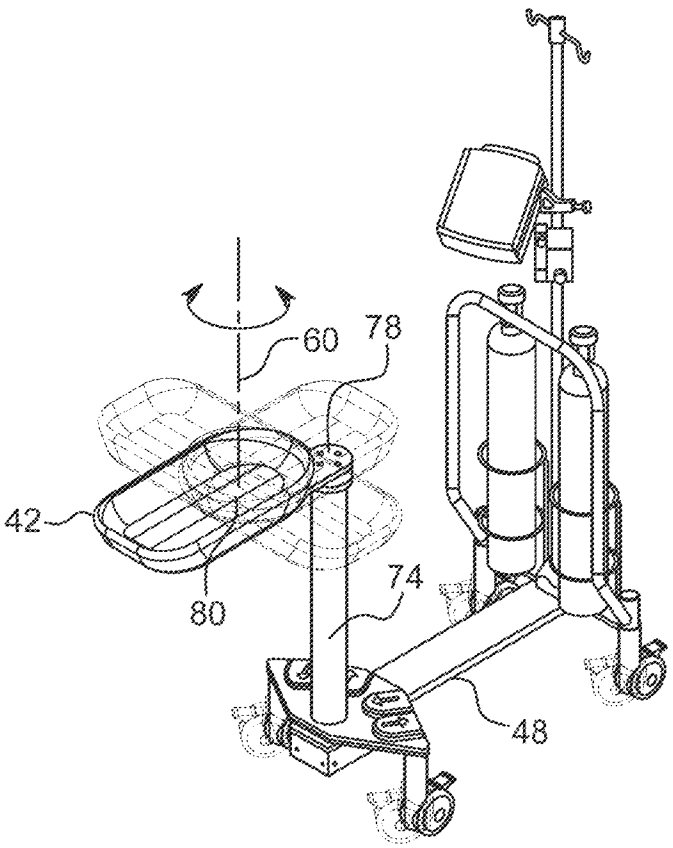

FIG. 11A likewise shows a perspective view of how the platform 42 may be rotated about its first axis of rotation 60 such that the platform 42 itself is rotated via coupling 80 into a full 360 degree arc. For comparison purposes, FIG. 11B shows a perspective view of how the platform 42 may be rotated about its second axis of rotation 62 such that the platform 42 and positioning arm 76 may be rotated into a full 360 degree arc. As above, the rotation of the platform 42 about its coupling 80 may be unhindered or it may be optionally limited or constrained to rotate within a limited or predefined field or angle or rotation.

Figure 12B:
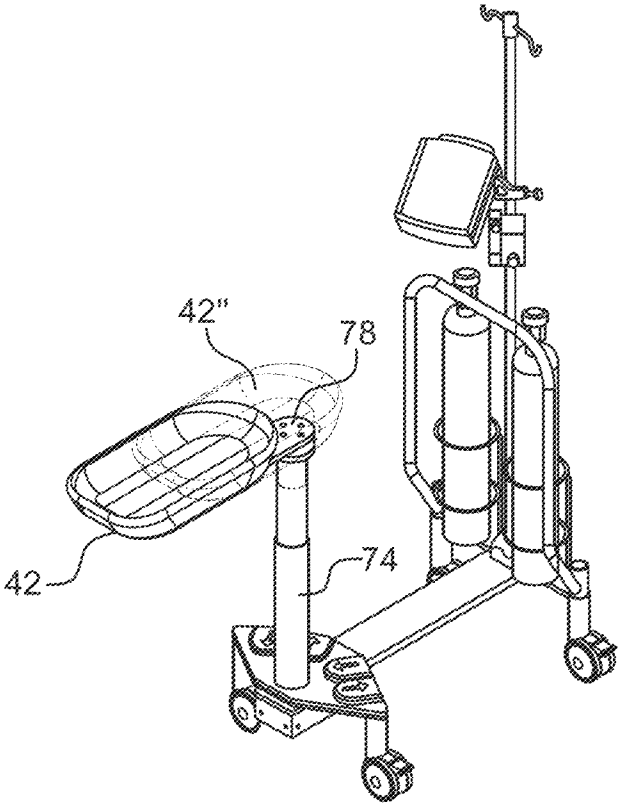
FIGS. 12A and 12B show perspective views of yet another example of how the platform may be adjusted in height as well as its longitudinal position for repositioning.
Figure 12A:
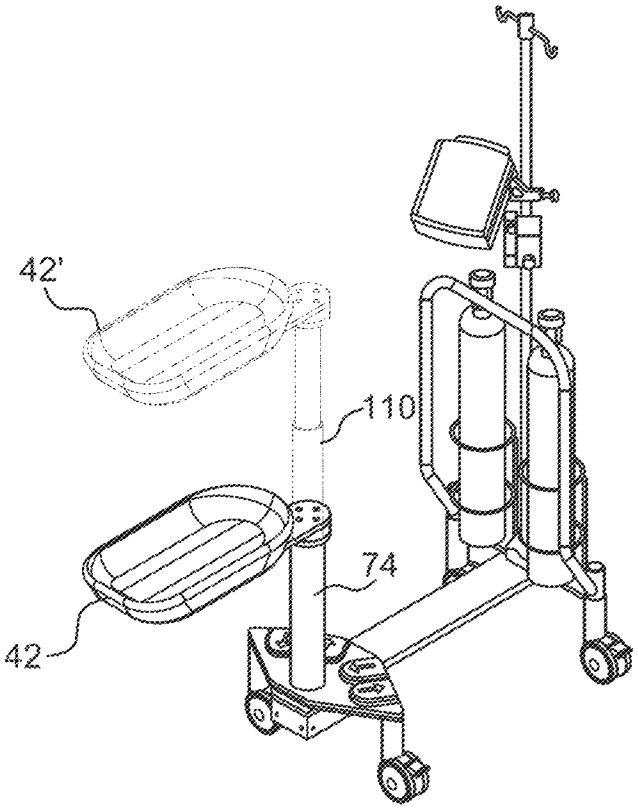

FIG. 12A shows a perspective view of another example of how the platform 42 may be adjusted in height, e.g., between a lower height and an upper height. As described, the platform 42 may be adjusted to a second platform height 42' via one or more telescoping members 110. FIG. 12B shows a perspective view of yet another example of how the platform 42 may be adjusted in its longitudinal position to second position 42" by translating the platform longitudinally relative to coupling 78.

Figure 13:
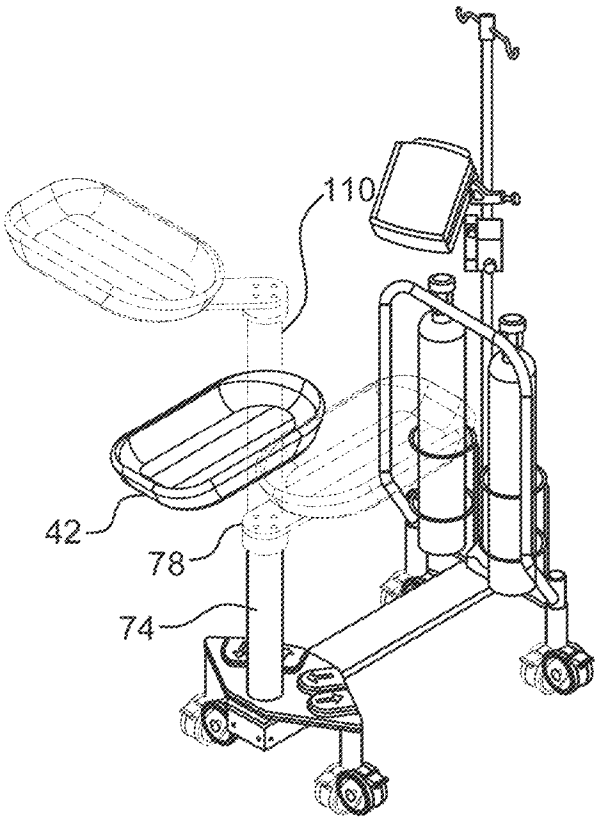
FIG. 13 shows a perspective view of yet another example of the various configurations in which the platform may be positioned.

FIG. 13 shows a perspective view of yet another example illustrating combinations of some of the various configurations described herein that the platform 42 may be positioned. For instance, the platform 42 may be raised or lowered as well as rotated about its first and/or second axes of rotation to configure the platform 42 into any number of positions and orientations. Any of the adjustments shown or described herein may be used in any number of combinations with one another to alter the configuration of the platform 42 and are intended to be within the scope of this description. Examples of combinations may include rotation of the platform 42 about its first, second, and/or third axes of rotation and where the platform 42 may be raised via one or more telescoping members 110 and/or extended longitudinally relative to its coupling 80.

Figure 14B:
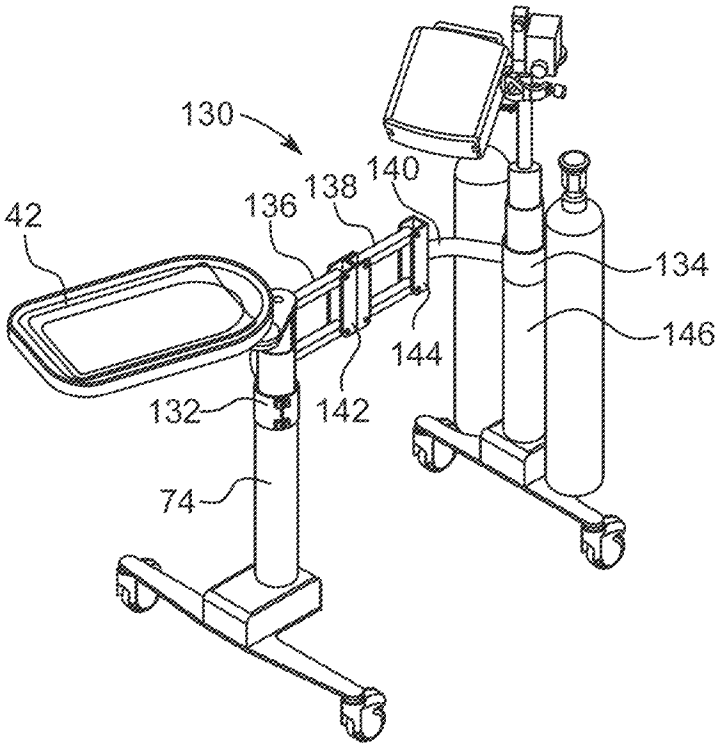
FIGS. 14A and 14B show perspective views of yet another variation of the platform assembly having an extendable positioning arm.
Figure 14A:
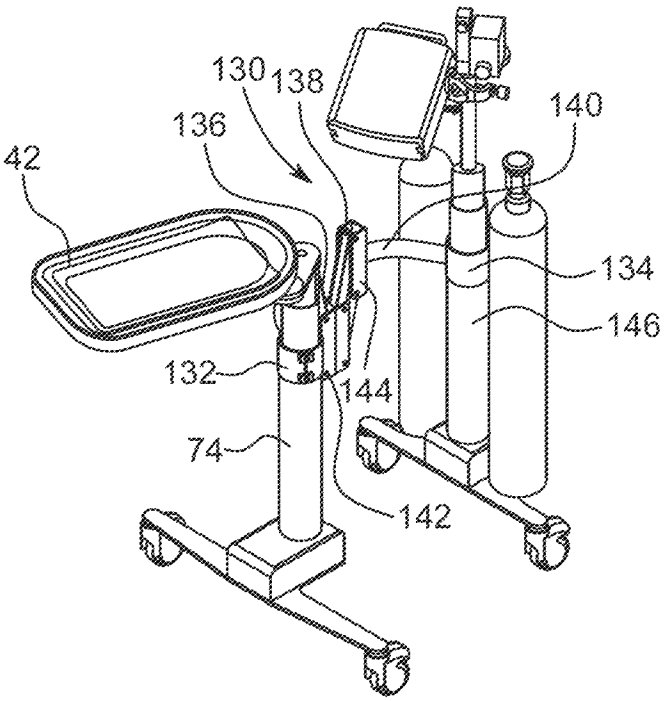

Aside from the movement of the platform 42 itself, the connecting structure 48 between the platform portion 44 and base portion 52 may also be configured into alternative structures to provide additional flexibility in optimally adjusting the position of platform 42. FIGS. 14A and 14B show another variation of the utility cart assembly where the connecting structure 48 may be replaced by an extendable scaffolding assembly 130. The assembly 130 may be coupled via first attachment 132 to supporting column 74 and second attachment 134 to second supporting column 146. A first set of arm members 136 and a second set of arm members 138 may be pivotably coupled to one another via a first pivoting support 142 while a second pivoting support 144 may couple the second set of arm members 138 via a coupling arm 140 to the second attachment 134. To extend the position of the platform portion 44 away from the base portion 52, as shown, the first and second set of arm members 136, 138 may be pivoted relative to the first and second pivoting supports 142, 144 to reconfigure the arm members 136, 138 into their deployed (or retracted) positions. This alternative connecting structure may be used in any number of combinations with any of the articulating features described herein.

Figure 15B:
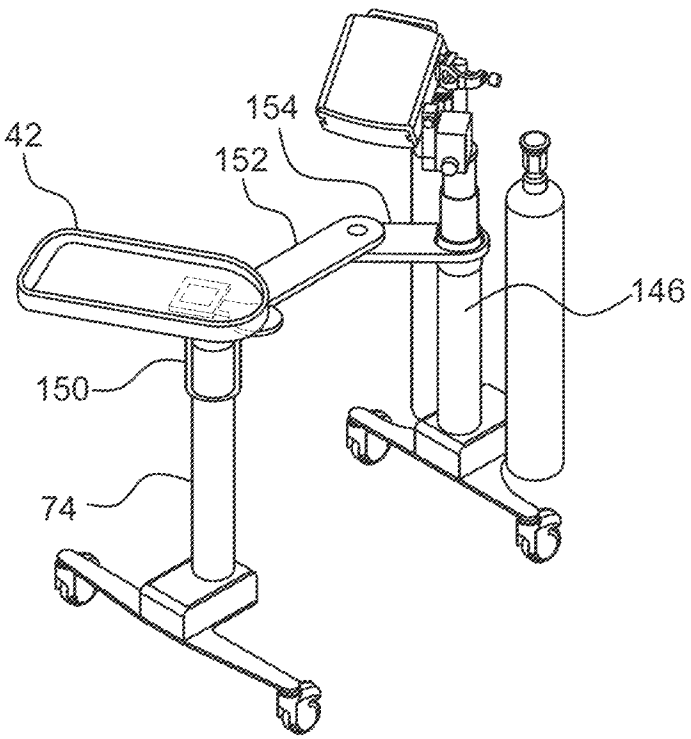
FIGS. 15A and 15B show perspective views of yet another variation of the platform assembly having another configuration for an extendable/collapsible positioning arm.
Figure 15A:
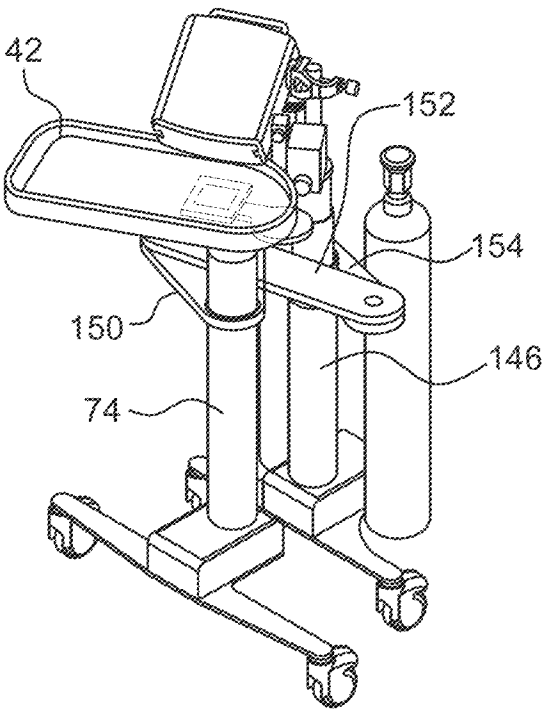
Figure 16A:
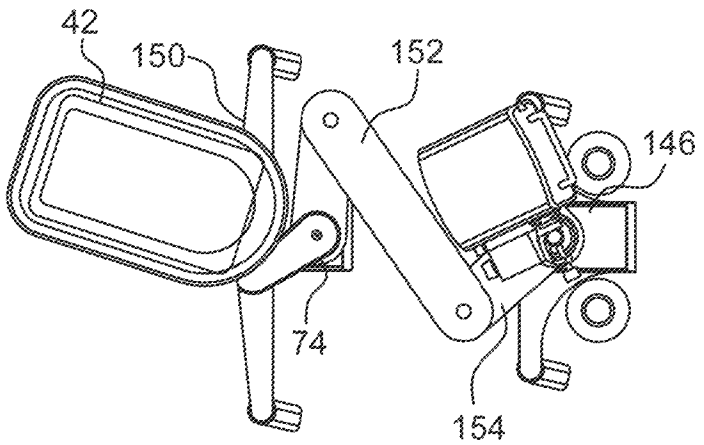
FIGS. 16A and 16B show top views of the variation of FIGS. 15A and 15B, respectively, to illustrate the reconfiguring positioning arm.
Figure 16B:
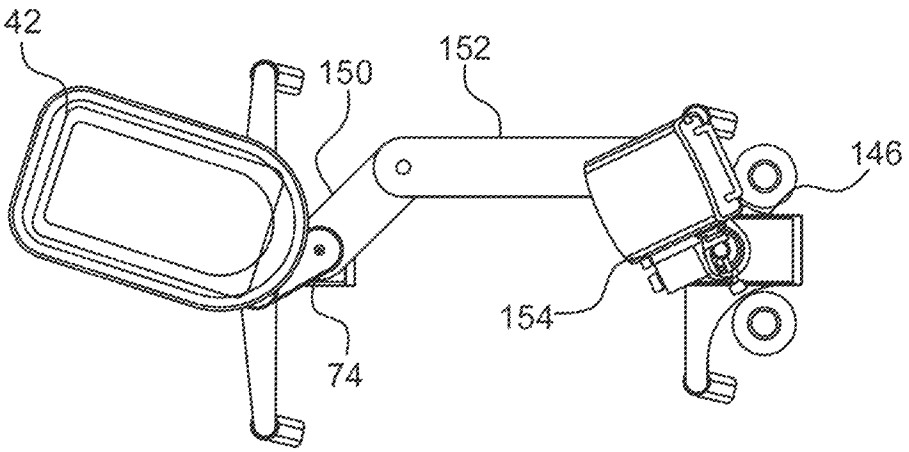

Yet another variation is shown of an alternative connecting structure in the perspective views of FIGS. 15A and 15B. This variation illustrates a connecting structure which may be comprised of one or more pivoting connecting arms attached to the platform portion via a first attachment 150 and to the base portion via a second attachment. The connecting arms, in this example, may be comprised of a first 150, second 152, and third 154 arm member which may be pivotably coupled to form an extendable structure. FIGS. 16A and 16B show top views of the connecting arms in its retracted and extended configurations correlating to FIGS. 15A and 15B, respectively. Any number of connecting arms having various lengths may be utilized in any number of combinations. Moreover, this variation of the connecting structure may likewise be used in any combination with any of the articulating features described herein.

Figure 17:
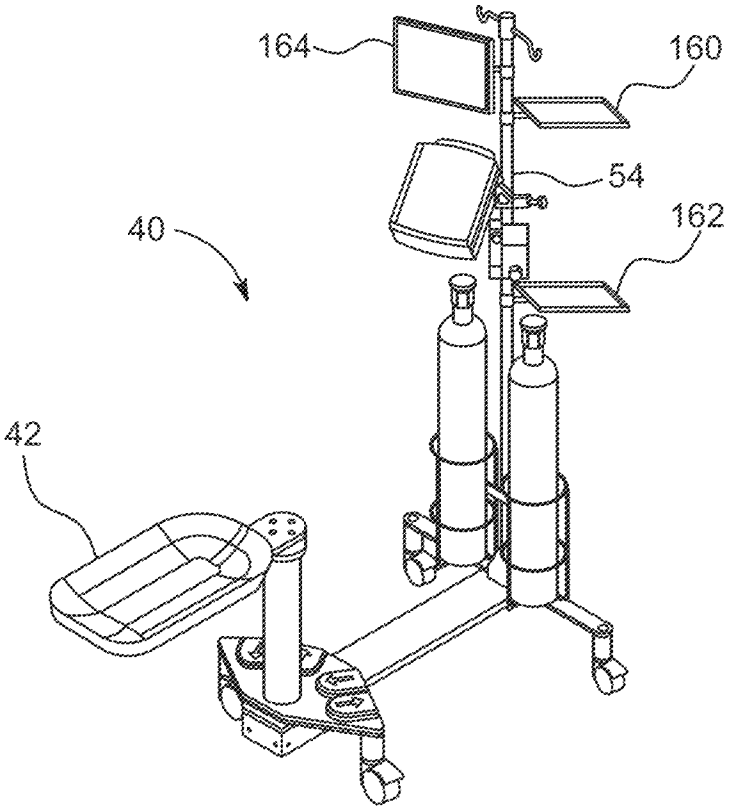
FIG. 17 shows a perspective view of another variation of the platform assembly incorporating one or more trays or shelves.

In yet another variation, any of the various embodiments described herein may incorporate one or more shelves or trays which may be attached to the assembly 40 for providing space for storage of various items. FIG. 17 shows a perspective view of one variation in which shelves or trays 160, 162 may be attached to the IV pole 54. Other variations may incorporate a single shelf or multiple shelves attached to either the pole 54 or another feature of the assembly 40, for example, beneath the platform 42 for ready accessibility. Additional arms may be attached to the base providing holding features, such as grippers, scales, cauterizing instruments, scanners, etc. The base may incorporate automatically adjusting weights or counterbalances to support safe reaching and supporting functions of the platform or other tool attached to the platform arm.

Other variations of the assembly 40 may also incorporate an on-board display or monitor 164 attached directly to the assembly 40. FIG. 17 further shows an example of how a display or monitor 164 may be attached, e.g., to the pole 54. This variation as well as any of the features described herein may be used in combination with any other features, as desirable.

Figure 18A:
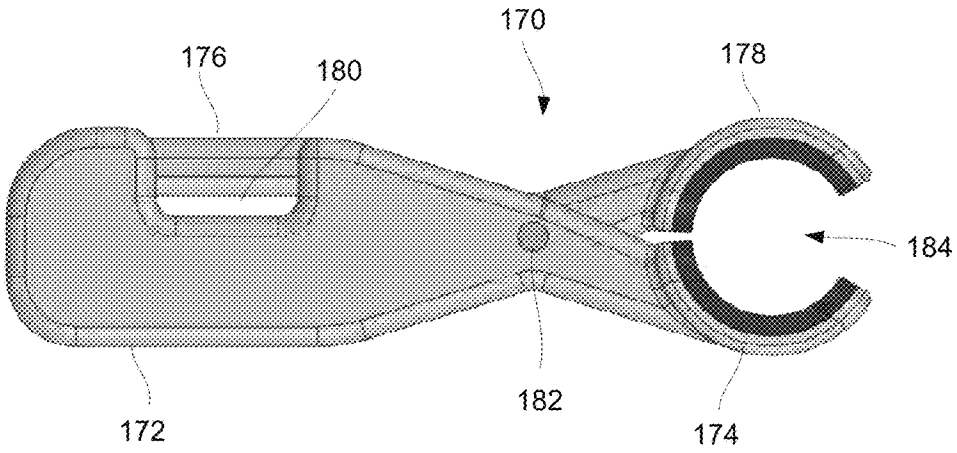
FIGS. 18A and 18B show top and perspective views of a handle assembly attachable to a pole and which may be used with any of the cart assemblies described.
Figure 18B:
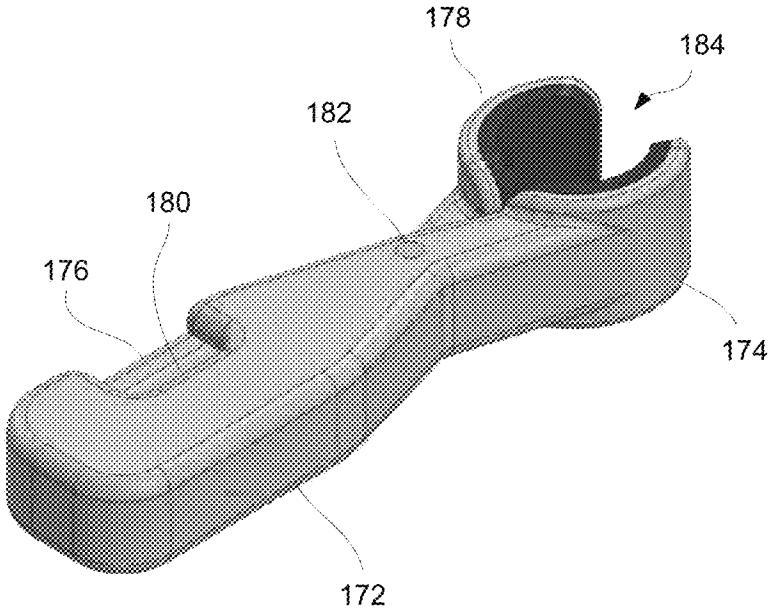

As described above, any number of features may be optionally incorporated into the assembly. One feature is shown in the top and perspective views of FIGS. 18A and 18B where an optional handle assembly may be used for attachment to the pole 54, e.g., to function as a handle to control the position of the base portion 52 or to function as an attachment to the pole 54 for any number of components. The handle assembly 170 may generally comprise a housing 172 which extends to form a first securement arm 174. The housing 172 may also partially retain an actuation arm 176 which extends to form a second securement arm 178 which together with the first securement arm 174 forms a receiving channel 184 for attachment to the pole 54. The actuation arm 176 may extend over or through a channel 180 defined by the housing 172 in a manner such that the housing 172 presents a relatively smooth surface for gripping by a user. A biasing element (e.g., torsional spring, spring, etc.) may be coupled to the actuation arm 176 within the housing 172 such that that actuation arm 176 and corresponding second securement arm 178 are maintained under a biasing force. This force may keep the first and second securement arms 174, 178 biased towards one another to maintain a clamping force against the pole 54 when in use. When the actuation arm 176 is depressed relative to the channel 180, the second securement arm 178 may rotate about a pivot 182 from a first position to a second position to allow for the gripping or release of the handle assembly 170 upon the pole 54.

Figure 18C:
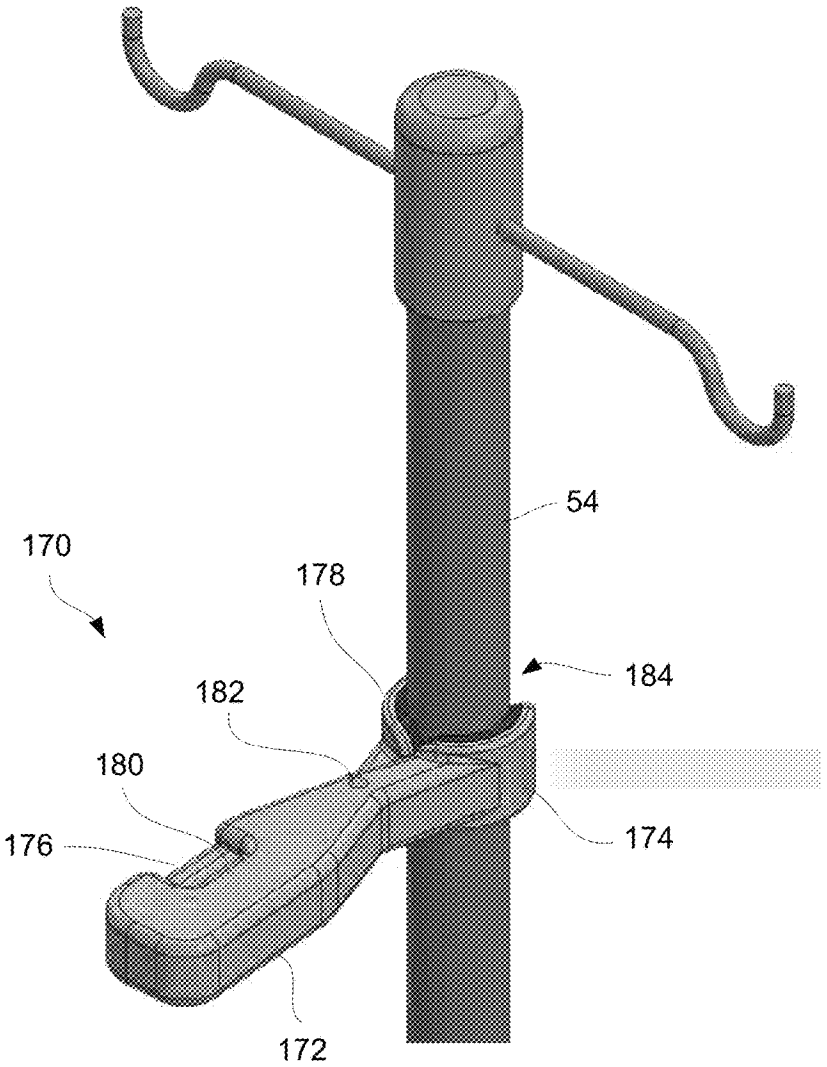
FIG. 18C shows a perspective view of the handle assembly releasably secured to a pole.

FIG. 18C shows a perspective view in one example of how the handle assembly 170 may be gripped upon the pole 54 such that the housing 172 member extends transversely relative to the pole 54. In other variations, the receiving channel 184 may be formed at an angle relative to the housing 172 such that the handle assembly 170 may extend at any number of angles relative to the pole 54. For instance, the handle assembly 170 may be secured to the pole to extend in parallel relative to the pole 54 or any number of angles as practicable. Because the handle assembly 170 is releasable, the assembly 170 may be positioned anywhere upon the length of the pole 54 and one or several handle assemblies 170 may be used. With the handle assembly 170 thus secured, the user may grip the assembly 170 to facilitate positioning of the assembly 40 or any components which may be attached to a handle assembly 170. The handle assembly 170 (or multiple handle assemblies) may be optionally used in combination with any of the various embodiments described herein.

Figure 19B:
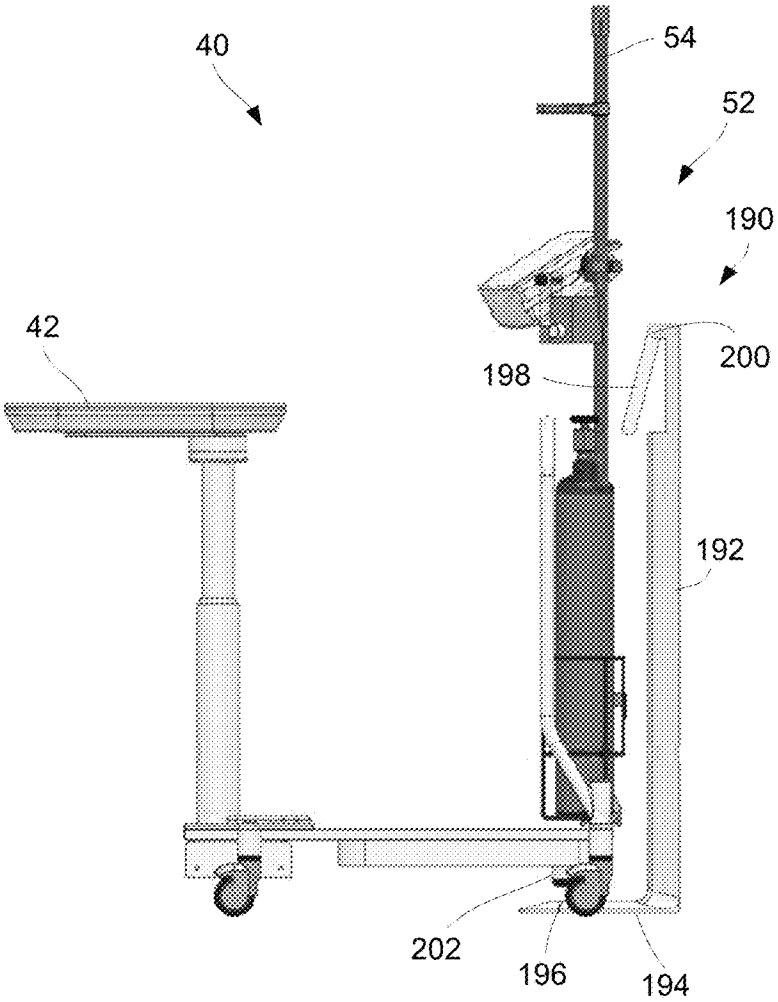
FIGS. 19A and 19B show side views of a docking station which may be used with a cart assembly.
Figure 19A:
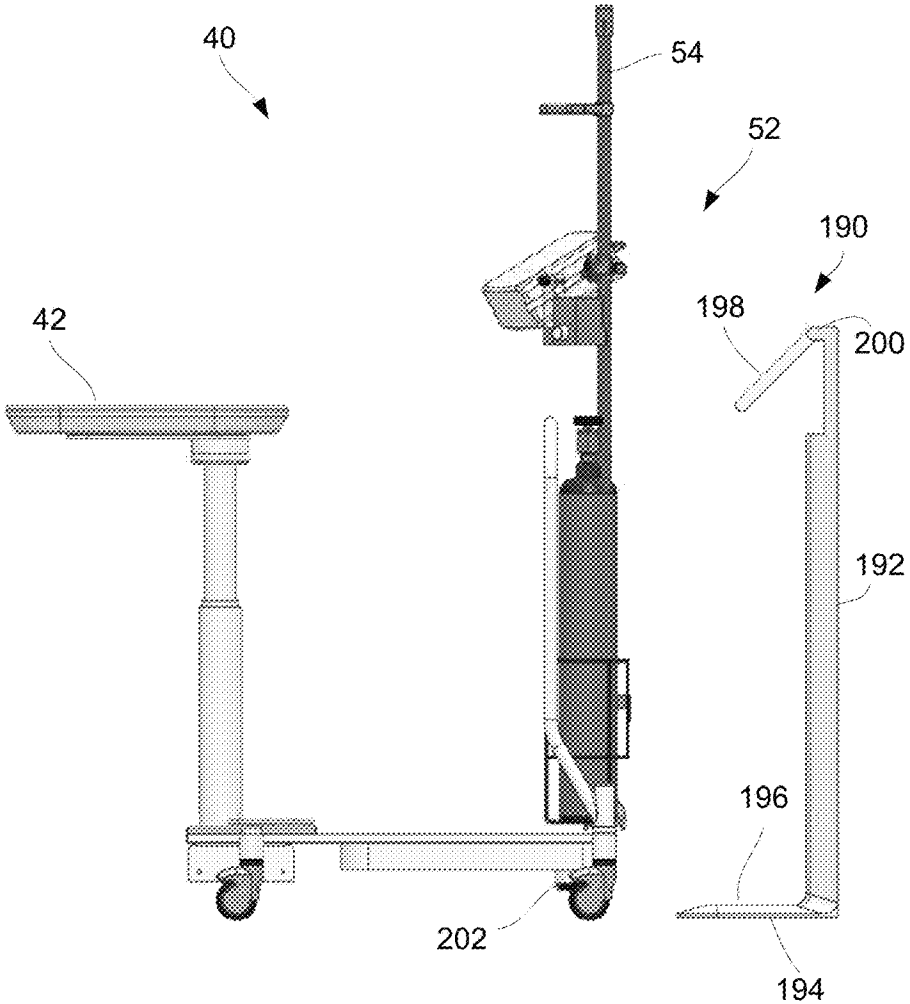

In yet another example of an accessory or feature which may be used with the assembly 40, FIGS. 19A and 19B illustrate side views of a docking station 190 which may be optionally integrated with an assembly 40. As described above, the docking station 190 may be used to supply power to the various accessories and the docking station 190 may also be used to transfer and/or store any information or data collected by one or more sensors which may be integrated or used with the assembly 40. The docking station 190 may be positioned in a stationary position within the hospital or clinic to provide a dock for the cart assembly during storage or after use.

In this variation, the docking station 190 may comprise a column or stand 192 extending from a base member 194. A docking station power and/or data transfer port 196 may be integrated within the base member 194 (or within the column or stand 192) such that when the assembly 40 is brought into proximity with the docking station 190, as shown in FIG. 19B, a corresponding cart assembly power and/or data transfer port 202 integrated along or within the assembly 40 (such as near or along a bottom portion of the cart assembly 40) may be positioned into apposition (either direct contact or into proximity) with the docking station power and/or data transfer port 196. An optional actuation switch 196 may be, e.g., pivotally connected via pivot 200, along the docking station 190 such that when the cart assembly 40 is brought into dock, the actuation switch 196 may be depressed or otherwise activated by the cart assembly 40 such that the power and/or data transfer is activated within the docking station 190.

Figure 20B:
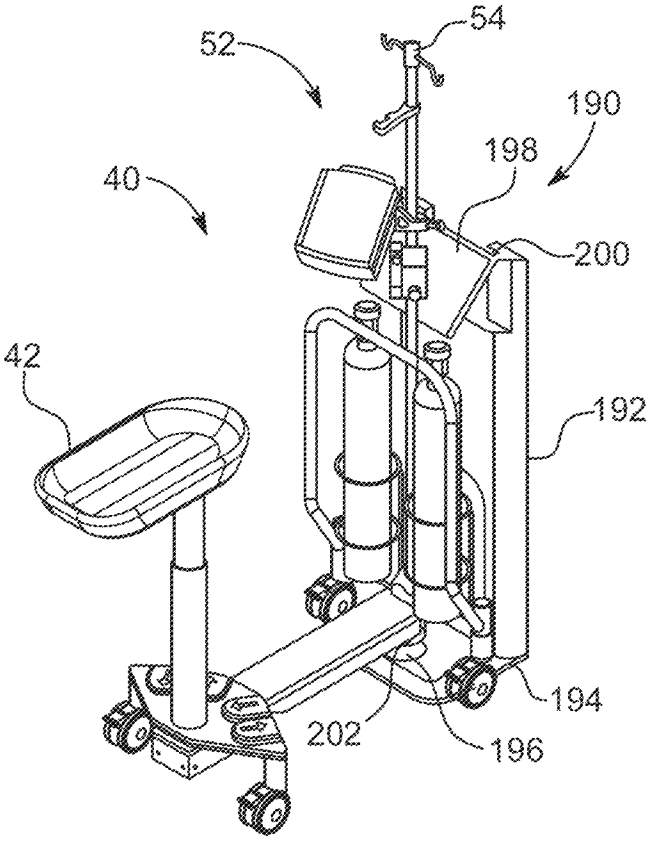
FIGS. 20A and 20B show perspective views of the docking station in proximity to the cart assembly.
Figure 20A:
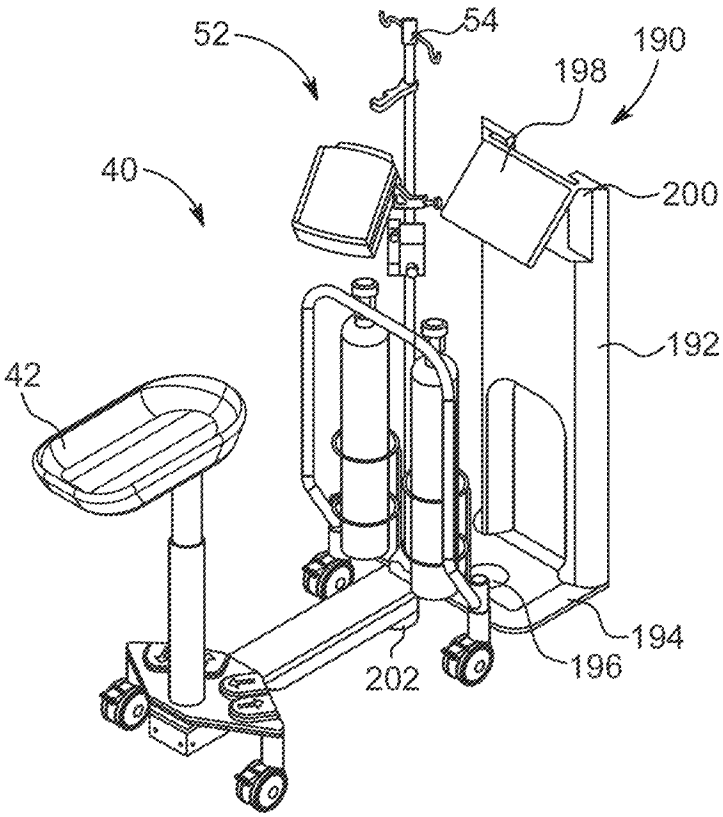

FIGS. 20A and 20B show perspective views of the cart assembly 40 and docking station 190 as the assembly 40 is brought into dock. The actuation switch 196 may be seen as being depressed by the assembly 40 to activate the docking station 190 and the docking station power and/or data transfer port 196 may be seen being brought into proximity with the corresponding cart assembly power and/or data transfer port 202.

The applications of the disclosed invention discussed above are not limited to certain treatments or applications, but may include any number of other processes, treatments, and applications outside of delayed cord clamping. Modification of the above-described methods and devices for carrying out the invention, and variations of aspects of the invention that are obvious to those of skill in the arts are intended to be within the scope of this disclosure. Moreover, various combinations of aspects between examples are also contemplated and are considered to be within the scope of this disclosure as well.

What is claimed is:

1. A utility cart assembly, comprising:

a platform configured to receive and support a newborn;

a positioning arm having a distal end coupled to the platform; and a supporting column having a first end coupled to a proximal end of the positioning arm;

wherein the platform is at least partially rotatable about a first axis of rotation between the platform and the positioning arm, wherein the positioning arm is at least partially rotatable about a second axis of rotation between the positioning arm and the supporting column, and wherein the supporting column is connected to, at a second end opposite to the first end, a plurality of foot control pedals which are configured to instruct articulation of the platform and/or the positioning arm around a respective one of the first and second axis of rotation.

2. The assembly of claim 1, further comprising a base portion operably coupled to the supporting column.

3. The assembly of claim 2, further comprising one or more accessories attachable to the base portion.

4. The assembly of claim 2, further comprising a power supply attachable to the base portion.

5. The assembly of claim 2, further comprising a controller or monitor attachable to the base portion.

6. The assembly of claim 1, wherein the platform further comprises one or more sensors configured for detecting or monitoring the newborn upon the platform.

7. The assembly of claim 6, wherein the one or more sensors comprise a visual or auditory sensor.

8. The assembly of claim 1, wherein the platform further comprises one or more lights integrated into the platform.

9. The assembly of claim 1, wherein the platform is translatable relative to the positioning arm.

10. The assembly of claim 1, wherein the platform is rotatably coupled to the positioning arm.

11. The assembly of claim 1, wherein the platform is further rotatable about a longitudinal axis defined by the platform.

12. The assembly of claim 1, wherein the platform is further configured to be angled relative to the positioning arm.

13. The assembly of claim 1, wherein the platform further comprises an enclosure.

14. The assembly of claim 1, wherein first axis of rotation defines a first plane and the second axis of rotation defines a second plane.

15. The assembly of claim 14, wherein the first plane and the second plane are parallel with one another.

16. The assembly of claim 1, wherein the platform is at least partially rotatable about a third axis of rotation.

17. The assembly of claim 1, wherein the platform is translatable in a vertical direction to adjust a height of the platform.

18. A utility cart assembly, comprising:

a platform portion having a platform supported via a positioning arm coupled to a supporting column at a first end of the supporting column; and a base portion attached to the platform portion via a connecting structure, wherein the platform is at least partially rotatable about a first axis of rotation, wherein the positioning arm is at least partially rotatable about a second axis of rotation, wherein the assembly is at least partially rotatable about a third axis of rotation, and wherein the supporting column is connected to, at a second end opposite to the first end, a plurality of foot control pedals which are configured to instruct articulation of the platform and/or the positioning arm around a respective one of the first and second axis of rotation.

19. The assembly of claim 18, further comprising one or more accessories attachable to the base portion.

20. The assembly of claim 18, further comprising a power supply attachable to the base portion.

21. The assembly of claim 18, further comprising a controller or monitor attachable to the base portion.

22. The assembly of claim 18, wherein the platform further comprises one or more sensors configured for detecting or monitoring the newborn upon the platform.

23. The assembly of claim 22, wherein the one or more sensors comprise a visual or auditory sensor.

24. The assembly of claim 18, wherein the platform further comprises one or more lights integrated into the platform.

25. The assembly of claim 18, wherein the platform is translatable relative to the positioning arm.

26. The assembly of claim 18, wherein the platform is further rotatable about a longitudinal axis defined by the platform.

27. The assembly of claim 18, wherein the platform is further configured to be angled relative to the positioning arm.

28. The assembly of claim 18, wherein the platform further comprises an enclosure.

29. The assembly of claim 18, wherein first axis of rotation defines a first plane and the second axis of rotation defines a second plane.

30. The assembly of claim 29, wherein the first plane and the second plane are parallel with one another.

31. The assembly of claim 18, wherein the platform is translatable in a vertical direction to adjust a height of the platform.

32. A method of positioning a utility cart assembly relative to a patient, comprising:

positioning a platform portion of the utility cart assembly adjacent to the patient, the platform portion having a platform supported via a positioning arm coupled to a supporting column at a first end of the supporting column;

rotating the platform about a first axis of rotation; and rotating the positioning arm about a second axis of rotation such that the platform is positioned into proximity to the patient, wherein the support column is connected to, at a second end opposite to the first end, a plurality of foot control pedals which are configured to instruct articulation of the platform and/or the positioning arm around a respective one of the first and second axis of rotation.

33. The method of claim 32, wherein positioning the platform portion of the utility cart assembly further comprises positioning a base portion of the utility cart assembly away from the patient.

34. The method of claim 33, further comprising rotating the utility cart assembly about a third axis of rotation such that the platform is positioned into proximity to the patient.

35. The method of claim 32, further comprising detecting or monitoring one or more parameters within the platform via one or more sensors.

36. The method of claim 32, wherein rotating the platform and rotating the positioning arm comprises manually rotating the platform and positioning arm.

37. The method of claim 32, wherein rotating the platform and rotating the positioning arm comprises automatically rotating the platform and positioning arm via one or more motors.

38. The method of claim 32, further comprising longitudinally translating the platform relative to the positioning arm.

39. The method of claim 32, further comprising rotating the platform about a longitudinal axis defined by the platform.

40. The method of claim 32, further comprising angling the platform relative to the positioning arm.

41. The method of claim 32, further comprising translating the platform in a vertical direction to adjust a height of the platform.

* * * * *